US005320436A

United States Patent [19]

Hock et al.

[11] Patent Number: 5,320,436

[45] Date of Patent: Jun. 14, 1994

[54] PORTABLE PRINTER AND SHEET FEEDER

[75] Inventors: Ng L. Hock, Singapore, Singapore; James J. Girard, Boise, Id.; Lee G. Keen, Singapore, Singapore; James L. K. Chan, Singapore, Singapore; Chuin k. Lim, Singapore, Singapore

[73] Assignee: Hewlett-Packard Company, Palo Alto, Calif.

[21] Appl. No.: 524

[22] Filed: Jan. 4, 1993

Related U.S. Application Data

[63] Continuation of Ser. No. 887,517, May 19, 1992, abandoned.

[51] Int. Cl.[5] ..... B41J 25/34; B41J 5/00

[52] U.S. Cl. ..... 400/283; 400/703; 400/479

[58] Field of Search ..... 400/279, 283, 294, 303, 400/472, 477, 703, 705, 300, 479

[56] References Cited

U.S. PATENT DOCUMENTS 3,838,250 9/1974 Naas et al. ..... 400/705 X
4,856,924 8/1989 Sugino ..... 400/283

FOREIGN PATENT DOCUMENTS 565353 9/1984 Japan .
0034775 2/1989 Japan ..... 400/703
0053891 3/1989 Japan ..... 400/703

OTHER PUBLICATIONS

HP 2930 Series Printers Manual, "Applying Character Cartridge Labels", Oct. 1984.
HP 2930 Series Printer Manual, "Configuring printer And Host", pp. 2-1 thru 2-19, Oct. 1984.
HP 2675A Interactive Printing Terminal Manual, pp. 3-1 thru 3-9; Aug. 1980.
HP 2675A Interactive Printing Termial, pp. 9-1 thru 9-14; Aug. 1980.
HP 2673A Owner's Manual, 3-1 thru 3-7, May 1982.

*Primary Examiner*—Edgar S. Burr
*Assistant Examiner*—Christopher A. Bennett

[57] ABSTRACT

A portable ink-jet printer and sheet feeder which can be battery powered. The printer may be manually fed paper for operation independent of the sheet feeder. The printer and sheet feeder are mounted on a base and locked at 90 degrees to one another. They may then be rotated into two operating modes in which automatic sheet feeding occurs, one of which provides a straight paper feed path for relatively stiff print media and/or printing relatively dense graphics. A paper output system includes a pair of wings and a deflector which place various arches in the paper as it emerges from the printer to maintain it over the previously printed sheet to permit it to dry. The printer may be configured by driving a print carriage having an arrow thereon to different positions adjacent a menu. When the arrow is opposite a desired configuration option, the option is selected by pressing a button.

8 Claims, 34 Drawing Sheets

PORTABLE PRINTER AND SHEET FEEDER

CROSS REFERENCE TO RELATED APPLICATION(S)

This is a continuation of copending application Ser. No. 07/887,517 filed on May 19, 1992, now abandoned.

BACKGROUND OF THE INVENTION

1. Field of the Invention

The present invention relates to portable printers and sheet feeders and more particularly to such printers and feeders which are relatively small, light weight and which may be battery powered.

2. Description of the Related Art

A typical printer receives data from a computer for printing text and/or graphic images on print media such as paper. Often, printers have automatic sheet-feeding capability. A stack of paper is inserted into a tray in the printer which thereafter moves the paper, one sheet at a time, past a printing device, such as an ink-jet print cartridge. Generally the printer and paper feeder are integrally formed and have power requirements which make battery power impractical. Printers which are driven by desk-top computers and the like typically must be configured into different operating modes. To do so, information must be provided to the printer concerning different aspects of the printing. For example, there are commonly printer settings for paper size, high-quality versus high-speed (draft) printing, text size, character set selection and other variables which affect the manner in which a document is printed.

Prior art printers utilize DIP switches, keys and/or light emitting diodes to select various configuration options. Such prior art printers are somewhat cryptic in that the user typically needs a manual to interpret the meaning of a particular switch position.

It would be desirable to provide a method and apparatus for configuring a printer which is simple, easy to operate and intuitive. It would also be desirable to provide such a method and apparatus which is relatively inexpensive to implement in a printer design.

In liquid ink printing systems, such as ink jet printers, the ink or other liquid printing solution is wet immediately after the ink is applied to the paper (or other media such as an overhead transparency). The ink must dry before a subsequently printed sheet contacts the printed paper surface in order to avoid smudging the previously applied ink. Known methods of drying the ink include a heated platen. In that arrangement, a flat surface over which the paper glides after it has been printed on is heated. By heat conduction through the paper itself, drying of the ink is hastened so that the ink is sufficiently dried to prevent smudging when a newly printed page comes into contact with it.

Another known method of addressing the wet paper problem is by means of a pair of active wings, as is employed for example in the Hewlett-Packard DESK JET printers. The wings are called "active" because they are moveable, driven by an electro-mechanical assembly. The wings initially hold a newly printed page spaced apart from a previous printed sheet. After printing is complete, the wings move to a second position to allow the printed page to drop onto the previously printed sheet. Therefore, there is a delay equivalent to the time of printing an entire page before the printed page comes into contact with a previously printed page. In general, the object is to provide an adequate delay time before a newly printed page comes into contact with the last previously printed page so that the ink is sufficiently dry.

Known methods of addressing the wet paper path problem are inadequate, especially in the context of a portable ink jet printing system. In a portable ink jet printing system, size, weight and power requirements are critical. Size and weight considerations obviously are important to providing portability. Power requirements must be minimized to allow operation of the printing system using battery power. The heated platen method, in addition to requiring multiple components, draws substantial power from the power source in order to heat the platen. The "active wings," approach also is undesirable because of its complexity and power consumption for powering the electro-mechanical assemblies necessary for actuating the active wings. What is needed is a way to dry ink in a manner that minimizes size, weight and power requirements for use in a portable liquid ink printing system.

It would be desirable to provide a printer which delays depositing a printed sheet on top of a previously printed sheet until after a time elapses sufficient to allow the ink to dry on the previously printed sheet. It would also be desirable to provide such a printer which does not use excessive power and which neatly stacks printed pages as they exit the printer without smudging the newly printed ink.

SUMMARY OF THE INVENTION

The present invention comprises a printer and automatic sheet feeder which may be battery powered. The printer is usable independently of the sheet feeder in which case sheets are manually fed to the printer. When used together, the printer and sheet feeder are rotatable about a common axis into various operating modes, including one in which manual sheet feeding may be accomplished with the sheet feeder attached.

The sheet feeder includes a door having a pair of paper support arms which unfold therefrom for supporting paper in the feeder. The printer and sheet feeder of the invention further includes a cable management and restraint system for maintaining cables in an organized manner to prevent interference with operation of the printer and sheet feeder and to provide cable strain relief.

The feeder and printer may be locked at a preselected angle relative to one another to insure proper positioning in the operational mode. When the same are unlocked each may be rotated downwardly to a base and locked thereto for transporting or storing the printer and sheet feeder.

The printer and sheet feeder include means located adjacent the printer output for handling newly printed sheets in a manner which prevents ink smudging and which stacks printed sheets. The foregoing is accomplished in the context of a portable printer and does not require additional power requirements.

In a configuration mode, a pointer is mounted on the print cartridge carriage for pointing at a menu on the printer case for displaying and selecting different printer configuration options and for displaying an indication of remaining battery charge.

The printer may be used to print in one mode in which there is a straight paper feed path for printing particularly dense graphics or when the print media is relatively thick and/or stiff.

It would be desirable to provide a printer having the foregoing features.

The foregoing and other features and advantages of the invention will become more readily apparent from the following detailed description of a preferred embodiment which proceeds with reference to the drawings.

DETAILED DESCRIPTION OF THE PREFERRED EMBODIMENT

Figure 1:
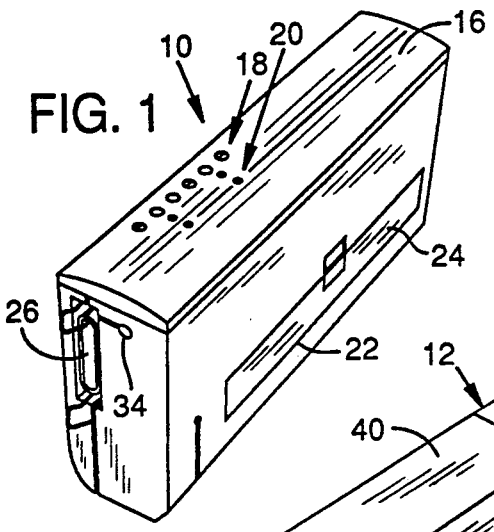
FIG. 1 is a perspective view of a printer constructed in accordance with the present invention and showing a front panel and a manual paper feed access hatch.
Figure 2:
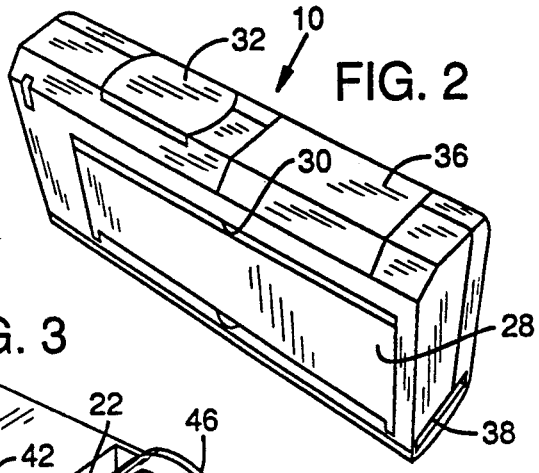
FIG. 2 is a perspective view of the printer of FIG. 1 inverted and showing a pen access hatch.
Figure 3:
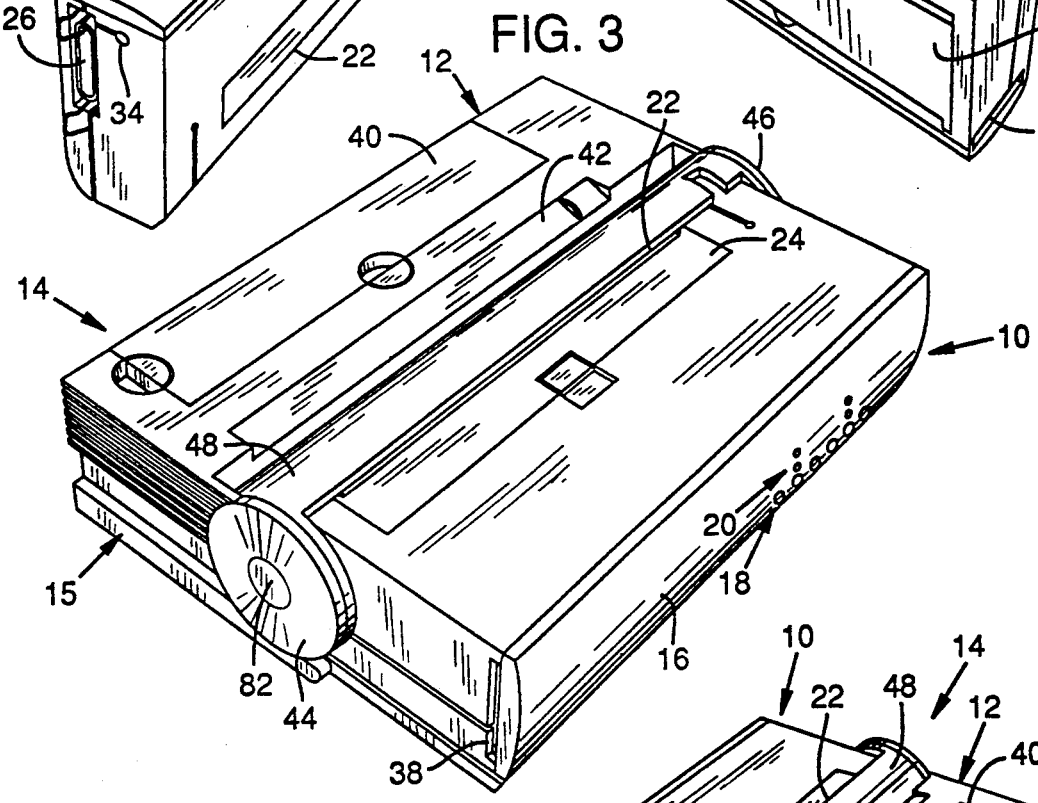
FIG. 3 is a perspective view of the printer of FIGS. 1 and 2 mounted on a base with an automatic sheet feeder constructed in accordance with the present invention.
Figure 4:
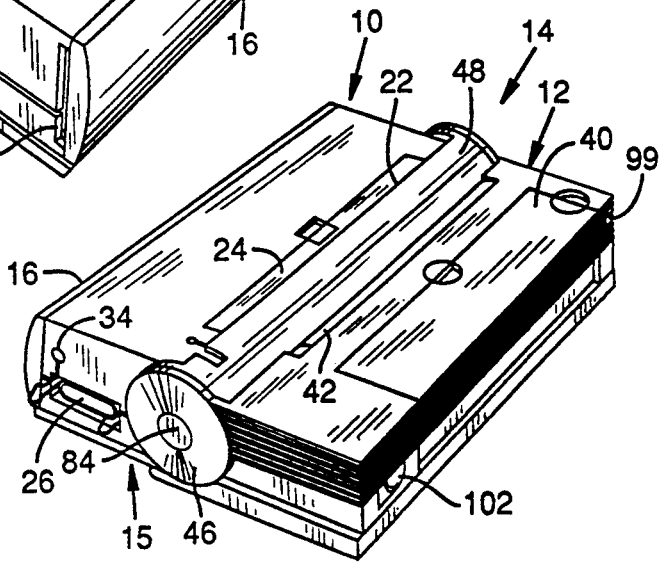
FIG. 4 is a rear perspective view of the printer and sheet feeder of FIG. 3.
Figure 5:
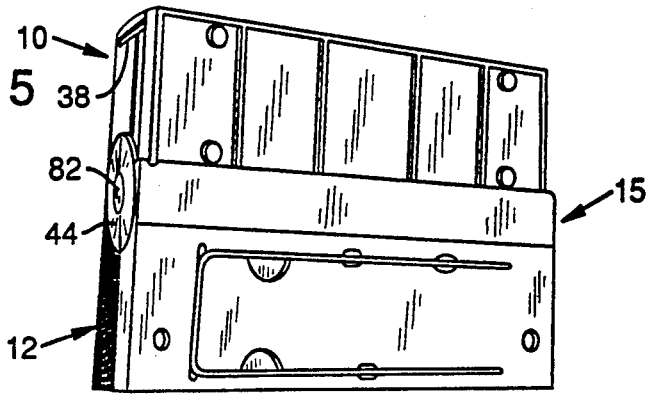
FIG. 5 is a bottom perspective view of the base, printer and sheet feeder.
Figure 6:
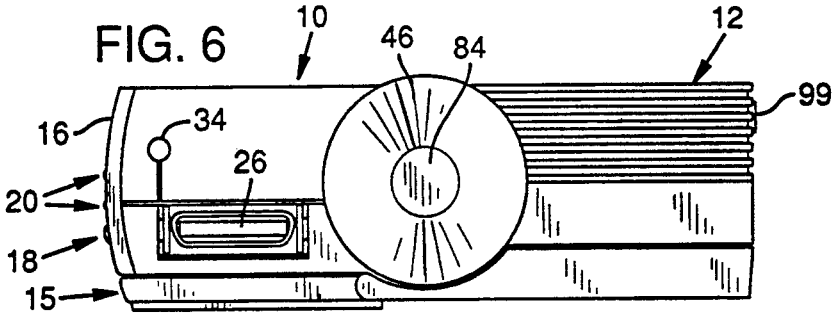
FIG. 6 is a right side elevational view of the base, printer and sheet feeder.
Figure 7:
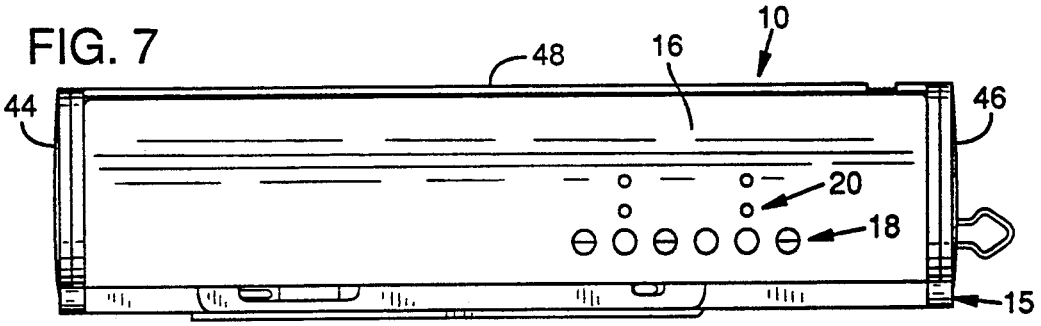
FIG. 7 is a front elevational view of the base, printer and sheet feeder.
Figure 8:
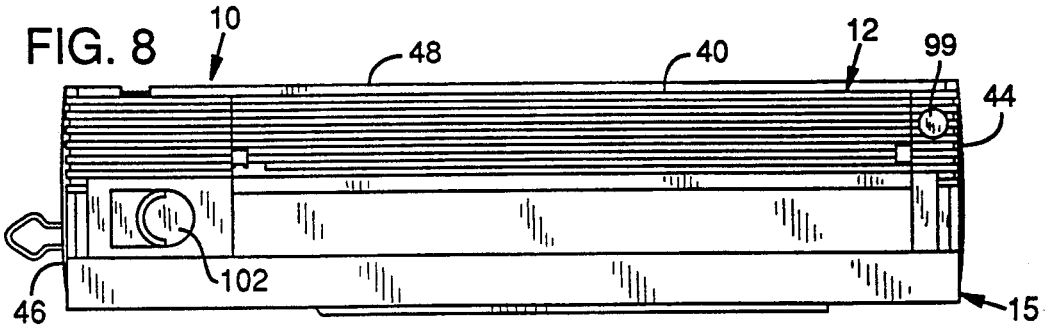
FIG. 8 is a rear elevational view of the base, printer and sheet feeder.

Turning now to the drawings and considering FIGS. 1–4, indicated generally at 10 is a portable printer constructed in accordance with the present invention. In the present embodiment of the invention, printer 10 is an ink-jet printer although other types of printers could also incorporate the present invention. In FIGS. 3 and 4 printer 10 is shown engaged with a portable sheet feeder 12 also constructed in accordance with the present invention. Printer 10 and sheet feeder 12 together mounted on a base 15 form a combined unit indicated generally at 14. As will later be more fully described, printer 10 is capable of operating in a stand-alone mode as shown in FIG. 1, and in conjunction with sheet feeder 12 as shown in FIGS. 3 and 4. Various operating configurations for unit 14 are shown and described later herein.

Printer 10 includes a removable control panel end cap 16 having a six button control panel, indicated generally at 18, mounted thereon. Control panel lights, indicated generally at 20, are mounted on end cap 16 above two of buttons 18. Additional detail is provided hereinafter, with reference to FIGS. 24 and 36, concerning the structure and functioning of panel 18 and panel lights 20.

A paper entrance slot 22 is formed on the lower edge of a feed roller access door 24. Door 24 is pivotally connected to the remainder of printer 10 via hinges at the lower edge thereof on opposite ends of the door. Slot 22 is defined between the hinges.

An interface port 26 comprises a conventional socket for receiving a plug from a computer for transferring image and text data to printer 10 in a known manner. A pen access door 28, also viewable in FIG. 22, includes a paper exit slot 30 formed beneath a lower edge 30 of door 28. Like door 24, door 28 is pivotally attached to the remainder of printer 10 via hinges at opposing ends of slot 30. Pen access door 28 provides access to an ink-jet print cartridge as will be described more fully in conjunction with FIG. 34.

A printer stand 32 comprises a substantially planar element which is pivotally attached to the remainder of printer 10 for rotation about an axis normal to stand 32. When stand 32 is pivoted 90° from the view of FIG. 2, it comprises a base which extends on either side of the printer for supporting it in the position illustrated in FIG. 1.

A power socket 34 is provided for connecting an AC power adaptor (not shown) to printer 10. A battery access door 36 provides access to a battery for running printer 10, with or without sheet feeder 12, on battery power rather than via an AC power adaptor inserted in socket 34.

A card slot 38 provides access to a conventional socket (not visible) inside of printer 10 for receiving a conventional font card through slot 38.

Figure 9:
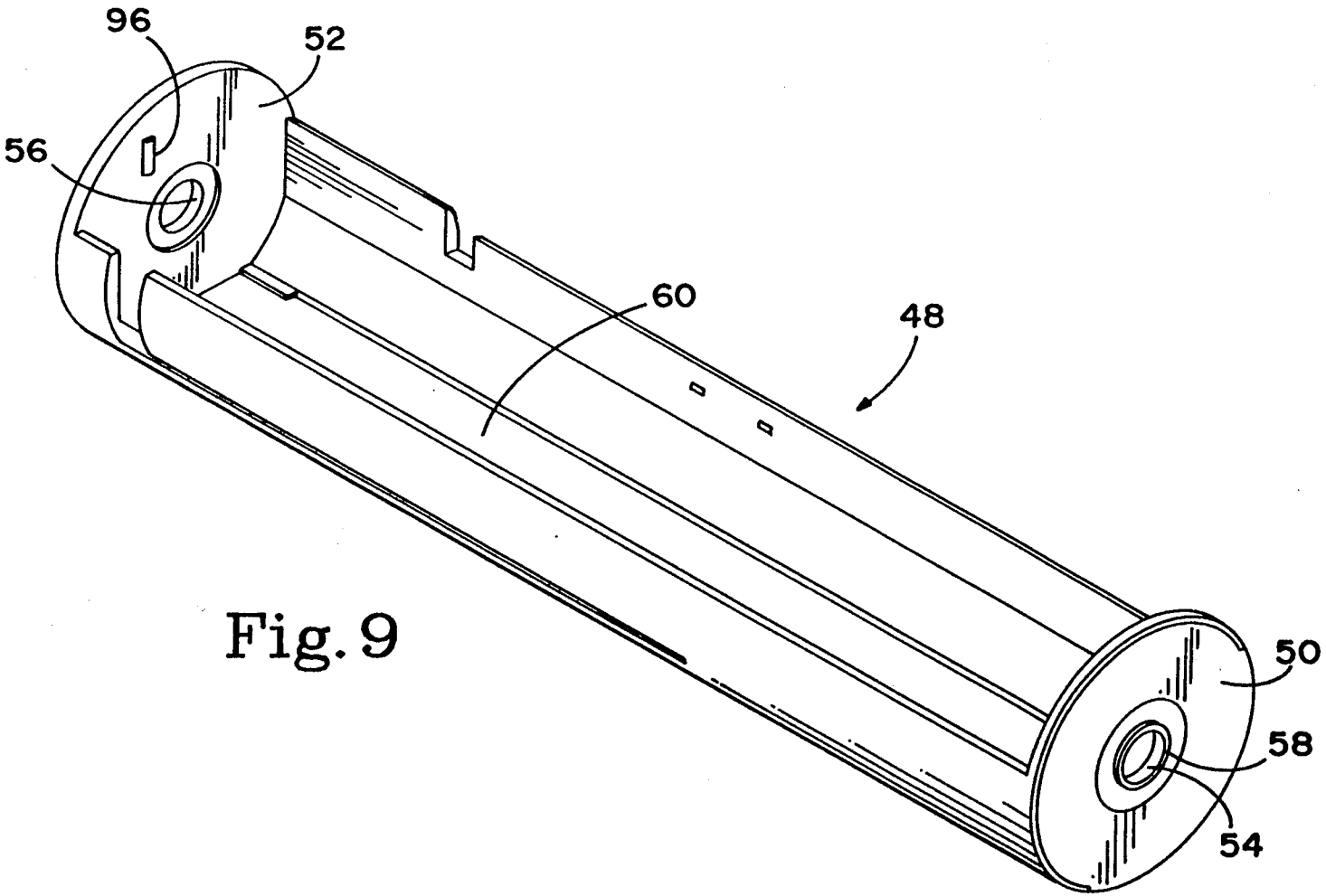
FIG. 9 is a perspective view of a rotatable housing which facilitates mounting the printer on the base.

Consideration will now be given to the external structure of portable sheet feeder 12. Sheet feeder 12 includes a paper access door 40 which opens for receiving paper to be fed by feeder 12 to printer 10 as will be later more fully described. A manual paper feed alignment guide 42 includes upright edges at either end thereof for aligning paper when the same is manually fed into printer 10 when unit 14 is configured for manual operation as will also be later described. Sheet feeder 12 includes a pair of arms 44, 46 which are integrally formed with the sheet feeder case which are circular in shape and concentric with one another. Each of arms 44, 46 extends laterally from opposite sides of the sheet feeder as shown. A rotatable housing 48 is received between arms 44, 46. Attention is directed to FIG. 9 for further description of housing 48.

Housing 48 is generally cylindrical in shape and includes a pair of opposed circular ends 50, 52. The ends include concentric bores 54, 56 each of which includes an annular lip, like lip 58, about the circumference thereof. Housing 48 includes an interior planar printer abutment surface 60 against which the lower end of printer 10, viewable in FIG. 2, abuts when the same is slidably fitted into housing 48 as in the views of FIGS. 3–8.

Figure 10:
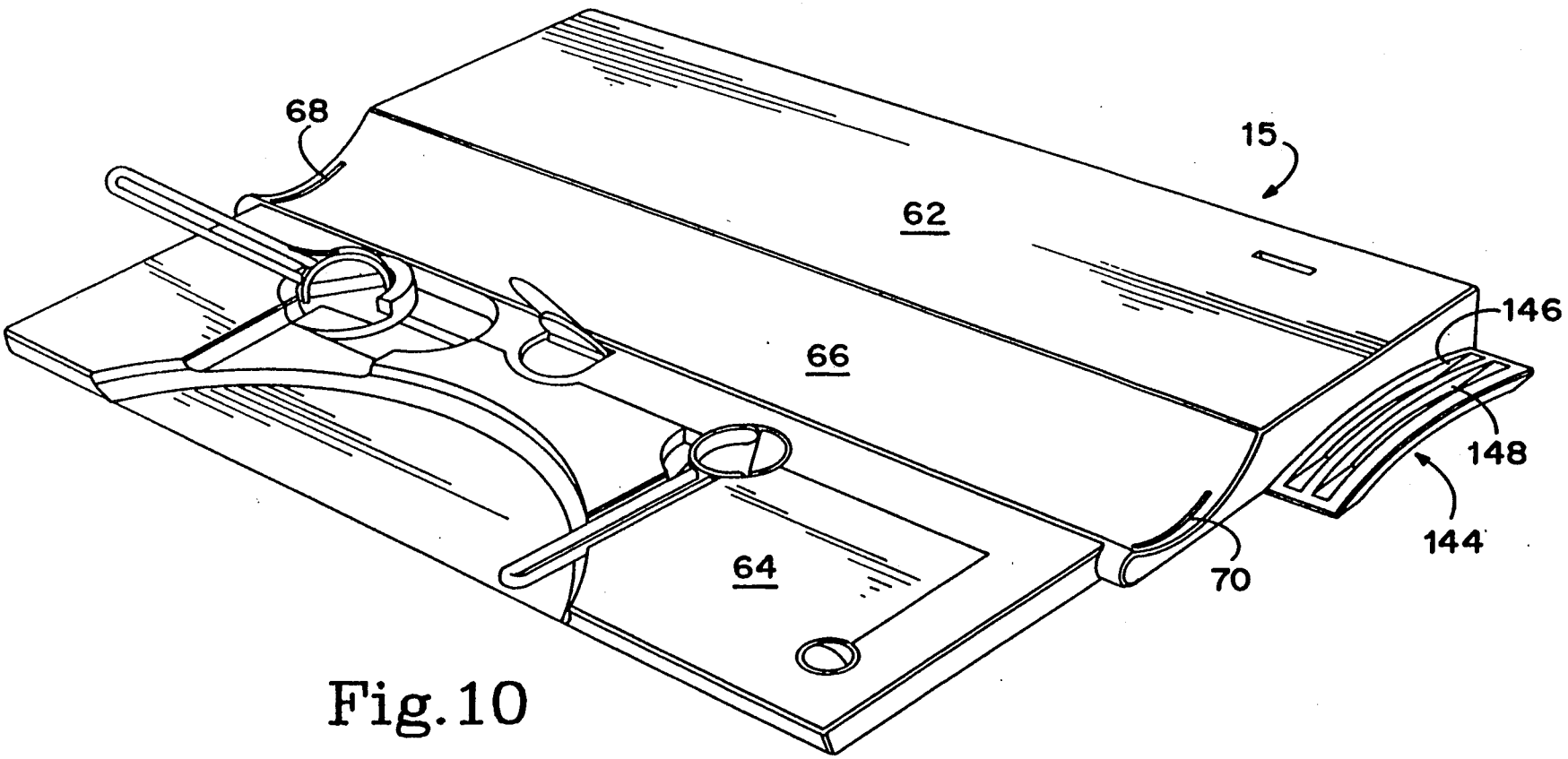
FIG. 10 is a perspective view of the base illustrating further a cable management system.
Figure 11:
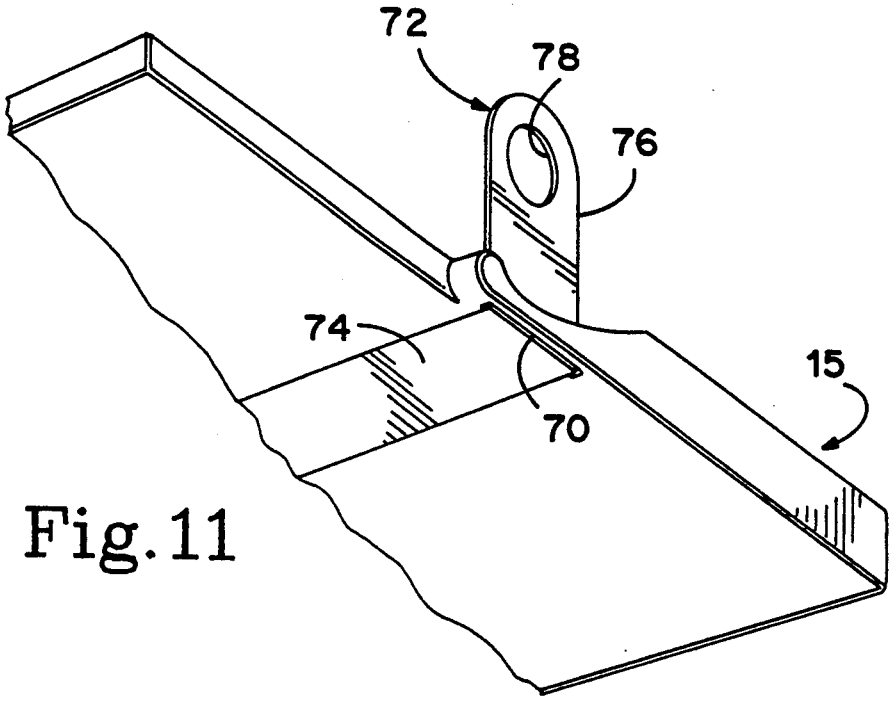
FIG. 11 is a partial perspective view of the underside of the base.

Base 15 is shown in FIG. 10 without either printer 10 or sheet feeder 12 mounted thereon. The base includes a sheet feeder support surface 62 and a printer support surface 64. In the views of FIGS. 3–8, sheet feeder 12 is supported on surface 62 and printer 10 is supported on surface 64. The outer cylindrical surface of housing 48 is received on a corresponding curved surface 66 in base 15. A pair of slots 68, 70 formed at either end of surface 66 receive a metal support bracket 72 (in FIG. 11) therethrough. Bracket 72 includes an elongate lower portion 74 which extends between slot 68, 70 on the lower surface of base 15. Bracket support posts, one of which is post 76, extend upwardly from opposite ends of portion 74 through slots 68, 70 like post 76 extends through slot 70 in FIG. 11. Each post includes circular opening, like opening 78 in post 76. Housing 48 is mounted on base 15 by inserting the annular lips, like lip 58, on either end of the housing into corresponding openings, like opening 78 (in FIG. 11), in the support bracket post, like post 76. Housing 48 therefore has a lower circular surface supported on corresponding circular surface 66 on base 15 while at the same time is rotatable about the longitudinal axis of housing 48.

Figure 22:
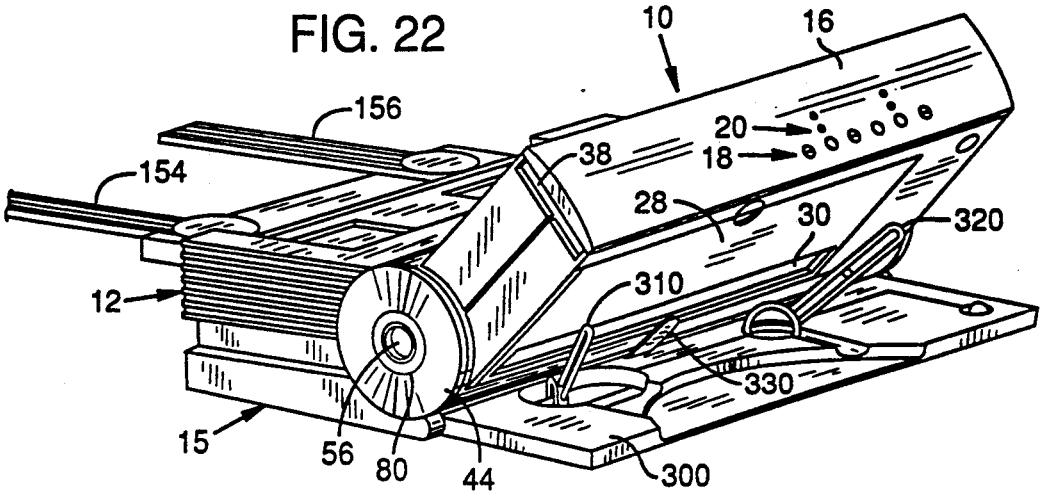
FIG. 22 is a front perspective view illustrating the printer and sheet feeder in another operational mode.

Each of arms 44, 46, includes a circular opening, like opening 80 in arm 44 (in FIG. 22). In the views of FIGS. 3 and 4 a locking hub 82 is inserted into opening 80 in arm 44. The locking hub includes fingers (not visible) which extend into the bores, like bore 56 (in FIG. 9), on either end of housing 48. Arm 46 and bore 54, on the other end of housing 48, include a corresponding locking hub 84 (in FIG. 4) received therethrough. Portable sheet feeder 12 is therefore rotatable about the central axis of housing 48, as is the housing itself. As will shortly be seen, in some circumstances feeder 12 and housing 48 are independently rotatable relative to one another, in other circumstances they may be locked in a predetermined relationship to one another and in still another condition they may be locked to the base as shown in FIGS. 3–8.

Figure 12:
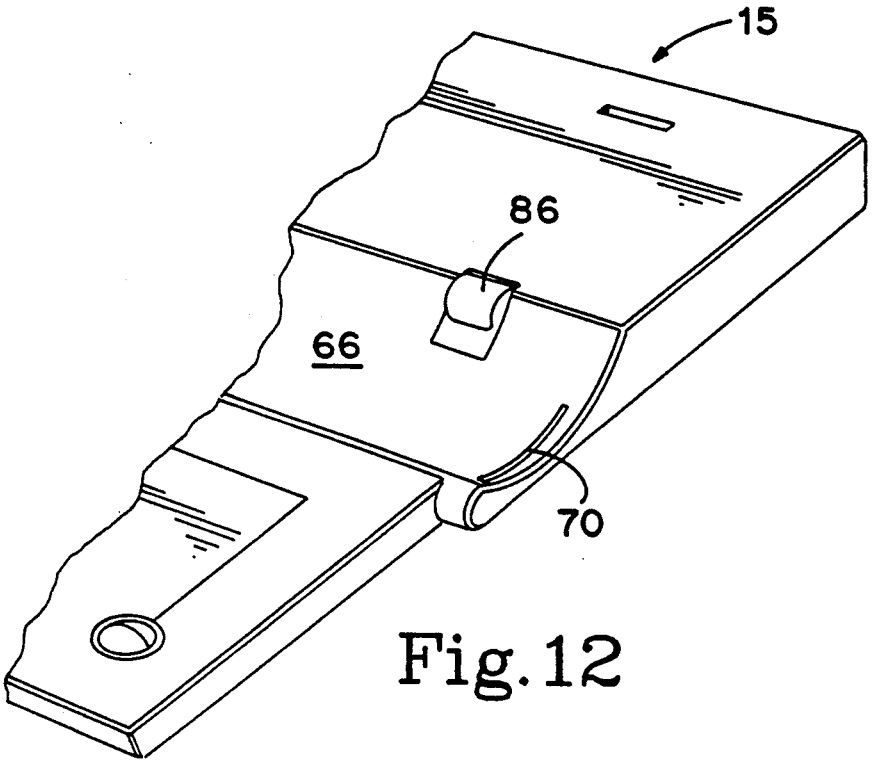
FIG. 12 is a partial perspective view of the top of the base.
Figure 13:
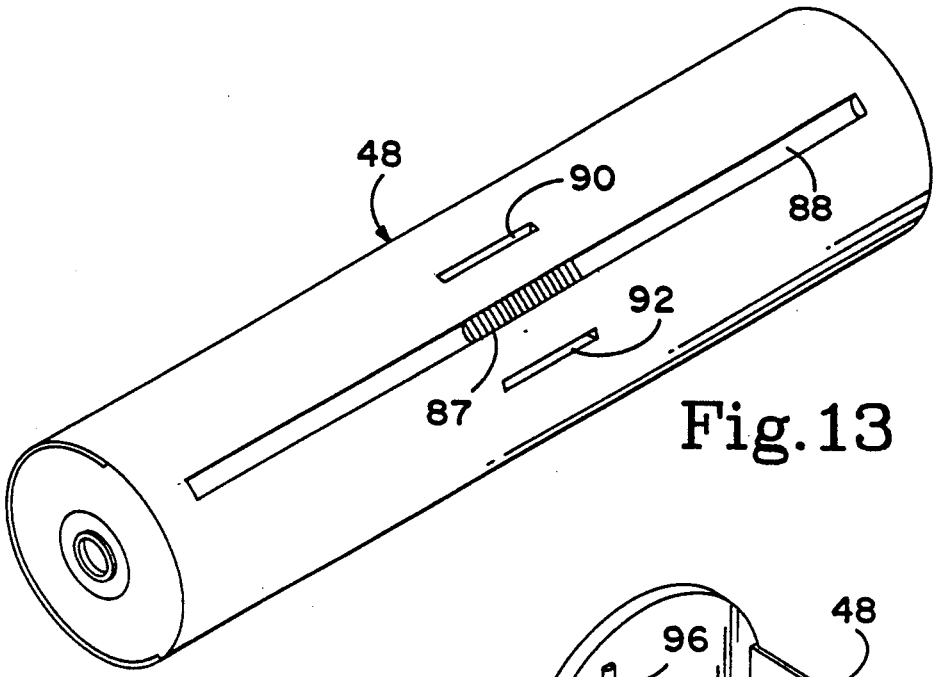
FIG. 13 is a perspective view of the rear of the rotatable housing.
Figure 15:
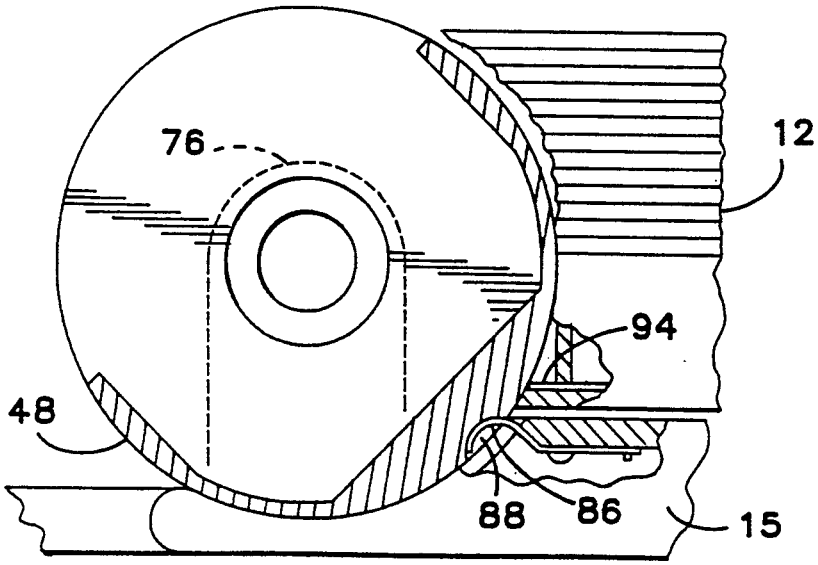
FIG. 15 is a partial sectional view showing the rotatable housing mounted on the base.

Turning now to FIGS. 12, 13 and 15, a plurality of indexing springs, one of which is spring 86, are mounted on the underside of base 15 beneath surface 66. Each of the springs extends upwardly through openings formed in surface 66 for engaging a slot 88 (in FIG. 13), formed on the underside of housing 48. Slot 88 includes a middle portion 87 which includes ribs which fill the slot for a purpose to be shortly described. Preferably the springs, like spring 86 are made of steel and are received in slot 88 as the housing rotates the slot across the springs. When so received, the springs act as a detente which hold housing 48 in a preselected position. Housing 48 is shown in the position in which the springs, like spring 86, are engaged in slot 88 in the views of FIGS. 20–23.

In FIG. 13, slots 90, 92 are formed in housing 48 for receiving an extensible metal tongue 94 (in FIGS. 15 and 16) which extends from one side of sheet feeder 12. In the view of FIG. 15, locking tongue 94 is not engaged with either of the slots; however, in FIG. 17, locking tongue 94 is shown engaged with slot 90 thereby locking housing 48 relative to sheet feeder 12 as shown. When so locked, combined units can be rotated into the configuration of FIGS. 20, 21 and 23 where the springs, like spring 86, which extend from surface 66 engage slot 88 thereby maintaining the configuration as shown.

Figure 14:
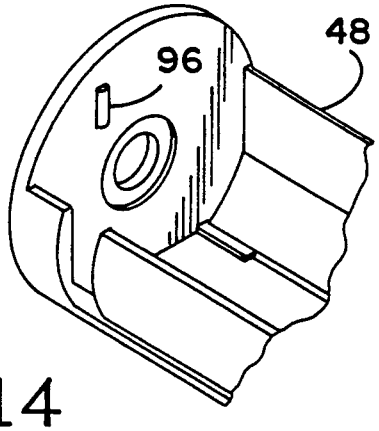
FIG. 14 is a partial perspective view of the interior of the rotatable housing.

Illustrated in FIG. 14 is a key 96 formed on housing 48 which cooperates with corresponding structure in printer 10 to insure that printer is oriented in only one direction, i.e. that shown in all of the drawings, when it is received in housing 48. Key 96 is also viewable in FIG. 9. An exploded view of unit 14 is illustrated in FIG. 18A.

Figure 16:
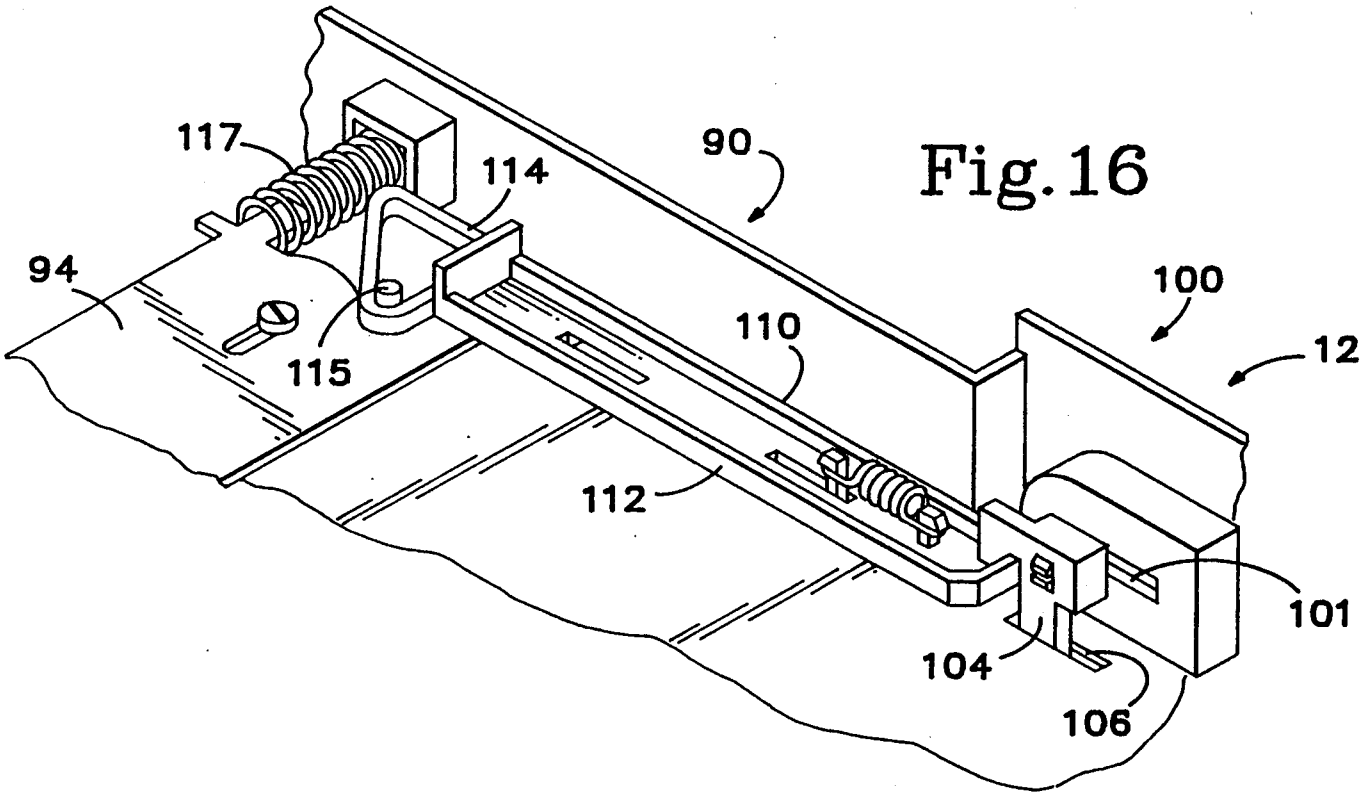
FIG. 16 is a partial perspective view of an interior portion of the sheet feeder.
Figure 17:
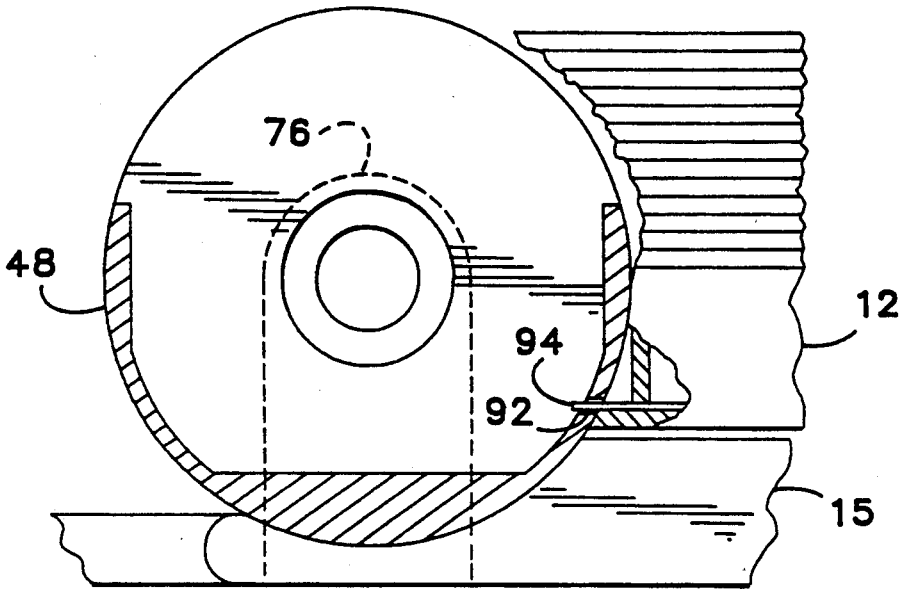
FIG. 17 is a view similar to FIG. 15 showing the rotatable housing in a different position.
Figure 18:
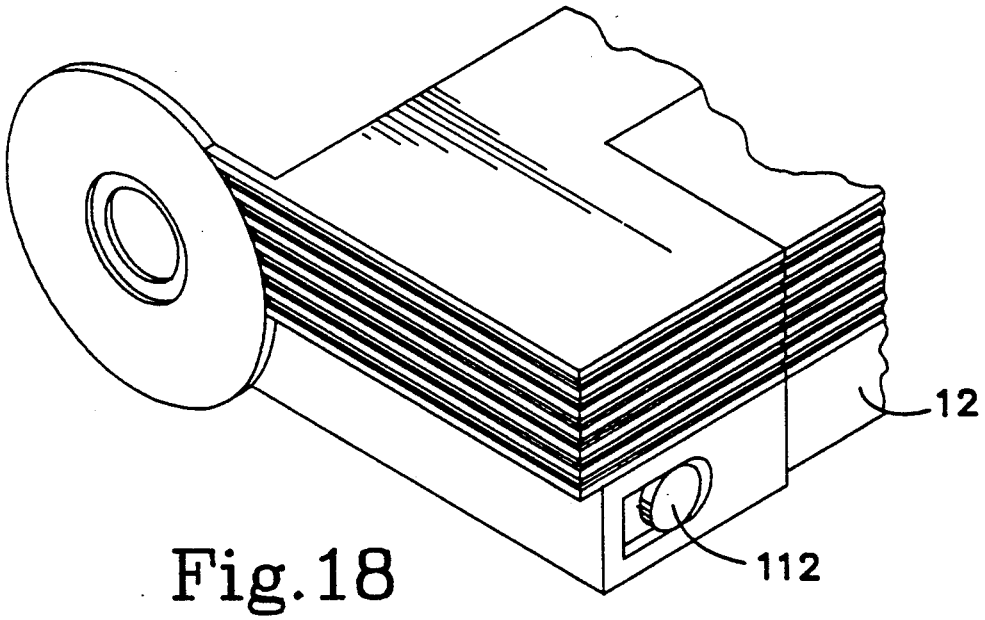
FIG. 18 is a partial perspective view of the automatic sheet feeder.
Figure 18A:
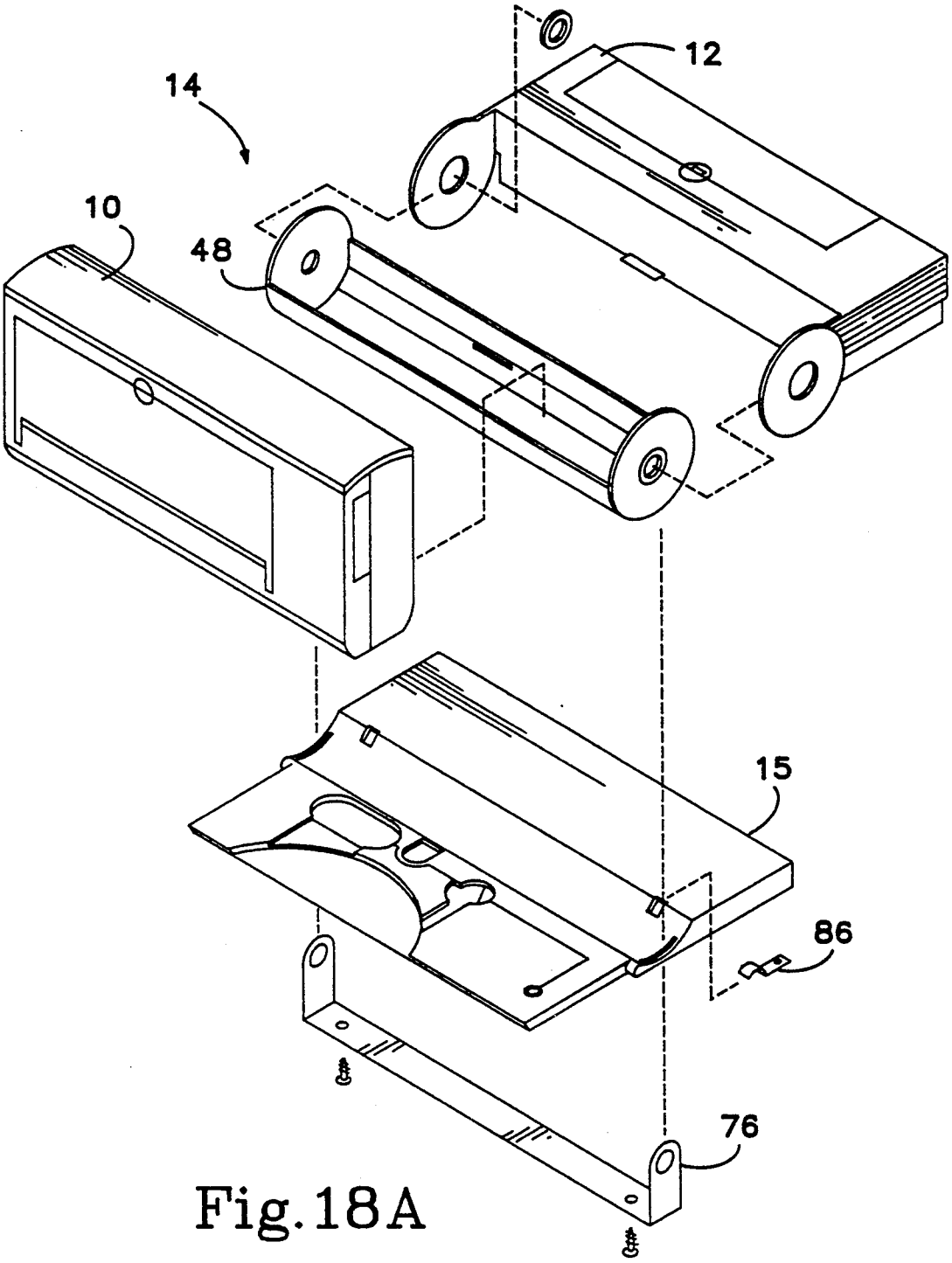
FIG. 18A is an exploded view of the printer, sheet feeder and base.

Turning now to FIGS. 16 and 18, indicated generally at 98 in FIG. 16 is a feeder locking mechanism. Locking mechanism 98 is released by sliding a control, indicated generally at 100, in the direction of arrow A. That portion of control 100 interior of sheet feeder 12 is visible in FIG. 16; a slidable button 102 is mounted on the exterior of feeder 12 and is visible in FIGS. 18 and 8. The button is mounted on that portion of control 100 which extends through a slot 101 formed in the sheet feeder case. As will be hereinafter described, sliding button 102 in the direction of the arrow unlocks feeder 12 from base 15 and also moves tongue 94 in the direction indicated by arrow C in FIG. 27 thereby unlocking feeder 12 from housing 48 if it is locked thereto.

Control 100 includes a downward projecting lug 104 which extends through a slot 106 formed on the lower side of feeder 12. The lower end of lug 106 terminates in a hook, as is viewable in FIG. 21, and is received in a slot 108 formed in base 15 for locking feeder 12 to the base whenever the feeder is in its lowermost position as viewed in FIGS. 3–8 and in FIG. 22.

Control 100 is connected to rods 110, 112 which in turn are connected to a triangular cam 114. Cam 114 moves against a contoured surface on tongue 94 thereby urging the same against housing 48, and into one of slots 90, 92 (in FIG. 24) when the tongue is opposite thereto. A cam follower 115 is mounted on tongue 94 and is received inside cam 114. When control 100 is moved in the direction of arrow A by manipulation of button 102, lug 104 moves relative to slot 108 to unlock feeder 12 from base 15 while simultaneously withdrawing tongue 94 from housing 48 thereby permitting free rotation of printer 10 and feeder 12 about the axis of housing 48. A spring 117 normally biases tongue 94 toward housing 48.

Figure 19A:
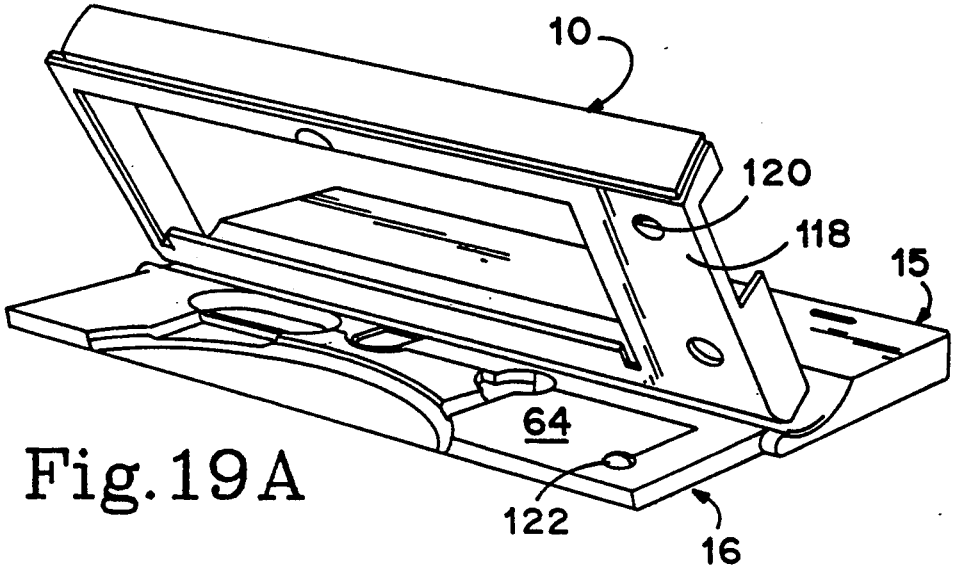
FIG. 19A is a partial perspective view of a portion of the printer and the base illustrating a spherical lock for locking the printer against lateral movement on the base.
Figure 19B:
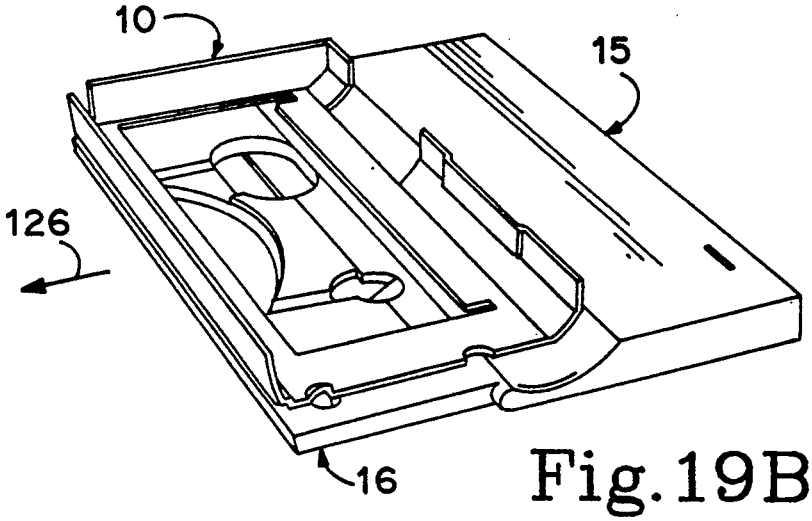
FIG. 19B is a view similar to FIG. 19A with the printer case on the base.
Figure 19C:
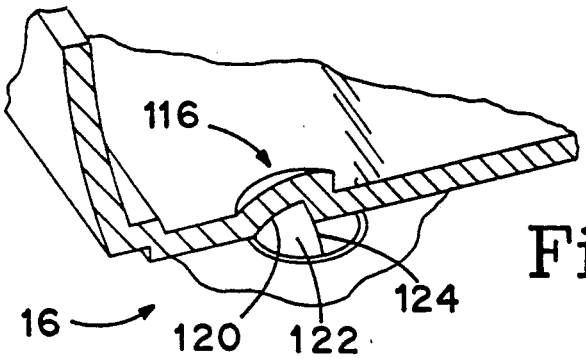
FIG. 19C is an enlarged view of a portion of FIG. 19B illustrating the spherical lock.

Turning now to FIGS. 19A, 19B and 19C printer 10 is shown with most of the printer broken away to expose the detail of a spherical engagement lock indicated generally at 16. Similarly, neither housing 48 nor sheet feeder 12 is shown for the purpose of illustration. Printer 10 includes a case 118 having a depression 120 formed therein. The depression includes a spherical surface which abuts against a corresponding spherical surface 122 formed on base 15. An edge 124 presents a planar surface which is substantially vertical to base surface 64 and which abuts against a corresponding surface on case 118. It can thus be seen that when printer 10 is pivoted downwardly from the position of FIG. 19A to the position of FIGS. 19B and 19C, edge 124 prevents movement of printer 10 in the direction of arrow 126. It should be noted that when sheet feeder 12 is in its lowermost position and printer 10 in its lowermost position as illustrated in FIGS. 3–8, tongue 94 is engaged with slot 92 thereby locking housing 48, and therefore printer 10, against rotational movement about the axis of the housing. With lug 104 locking sheet feeder 12 to base 15, with spherical engagement lock 116 preventing movement of printer 10, as indicated in FIG. 19B, and with tongue 94 engaged in slot 92 both the sheet feeder and printer are locked to the base in what is referred to herein as a transport or storage condition.

Figure 24:
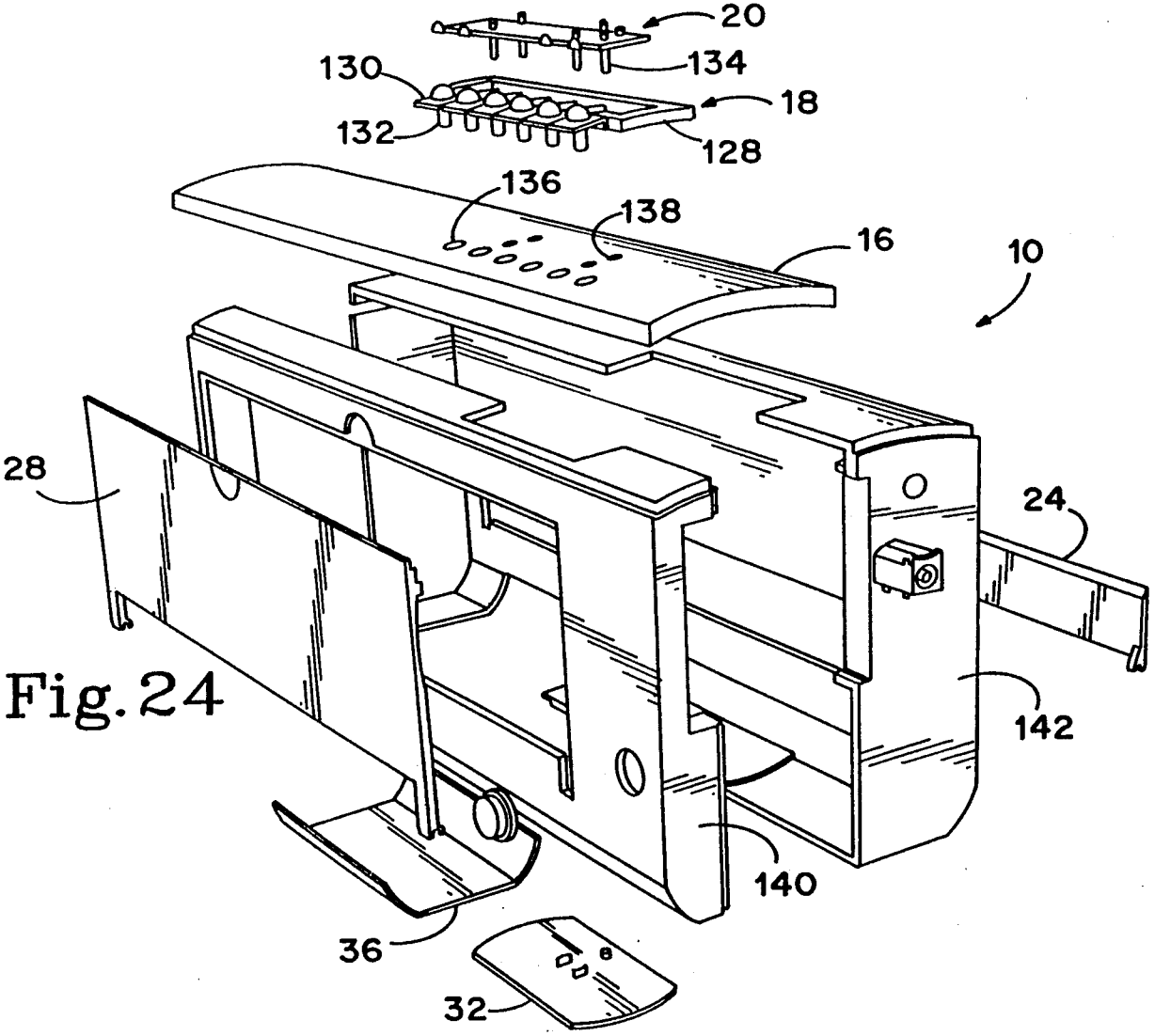
FIG. 24 is an exploded view of the case of the printer of FIGS. 1 and 2.

Turning now to FIG. 24 the case for printer 10 is illustrated in exploded view. Control panel 18 comprises a polymeric frame 128 having six tabs, like tab 130, extending therefrom. Each of the tabs has a button as shown mounted thereon. Each button includes a downwardly projecting portion 132. Frame 128, tabs 130 and portions 132 are integrally molded using a conventional process. Because the tabs, like tab 130, extend laterally from the frame, and due to the polymeric material from which panel 18 is molded, tabs 130 are flexible yet tend to retain the configuration shown in the drawing.

Control panel lights 20 are also molded from clear polymeric material suitable for transmitting light therethrough. Lights 20 rest within frame 128 and includes downwardly extending cylindrical portions, like portion 134, which are received through openings in selected ones of the tabs.

Panel 18 having lights 20 nested therein as described is urged against an upper interior surface (not visible) of end cap 16 and is held in position via downward projecting lugs (also not visible) on the lower surface of the end cap which are received within bores (not shown) formed in frame 128. When so installed, each of cylindrical portions 134 are received over a light emitting diode (LED) on a circuit board (not shown) received inside printer 10. Similarly, each of downward projecting cylindrical portions, like portion 132, is received over a switch mounted on the circuit board. Each of the rounded buttons extends through a circular opening, like circular opening 136 in end cap 16. Similarly, the upper end of each of cylindrical portions, like cylindrical portion 134, extends through a corresponding hole, like hole 138, in the end cap. End cap 16 includes printed labeling, not shown in FIG. 24, which identifies the function and alternative functions of each button as will be hereinafter later described. Such labeling is shown in English in FIG. 36.

End cap 16 includes downward projecting lugs for connecting the same to portions 140, 142 of the case for printer 10. End cap 16 is advantageous in that separate end caps can be produced which identify the button functions in different languages. The same control panel 18 and lights 20 can be integrated into each of the other end caps which are thereafter connected to the case. Thus, with virtually no extra expense printer 10 can be made with a professional finished appearance for different foreign markets.

Figure 25:
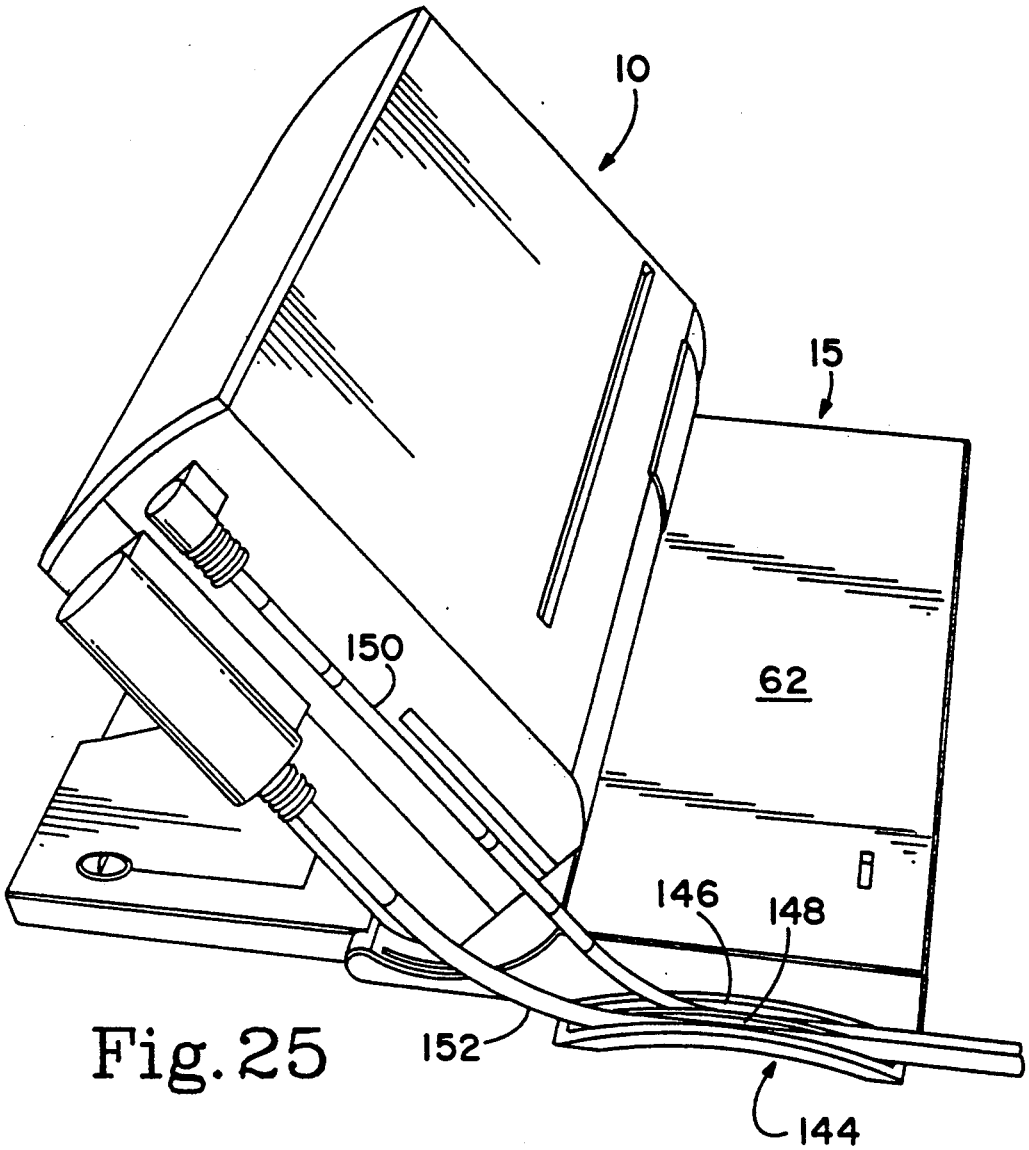
FIG. 25 is a perspective view of one embodiment of the printer and sheet feeder cable management system.

Turning now to FIG. 25, illustrated therein is base 15 and printer 10. Housing 48 and sheet feeder 12 are broken away in the view of FIG. 25 for the purpose of illustrating a cable holder 144. Holder 144 is also viewable in FIG. 10 and includes a pair of channels 146, 148.

Cable holder 144 is mounted on base 15 on one side of the base upon which surface 62 is formed. In the view of FIG. 25, a power cable 150, which is plugged into power socket 34 (in FIG. 1) is received in channel 146. A computer input/output cable 152 is received in channel 148. The cables are installed by positioning each cable over its associated channel and pressing the cable thereinto at an appropriate location along the length of the cable. Cable holder 144 provides strain relief as well as maintaining the cables in an organized manner so as not to interfere with other parts of the printer or with other items located nearby.

Figure 25C:
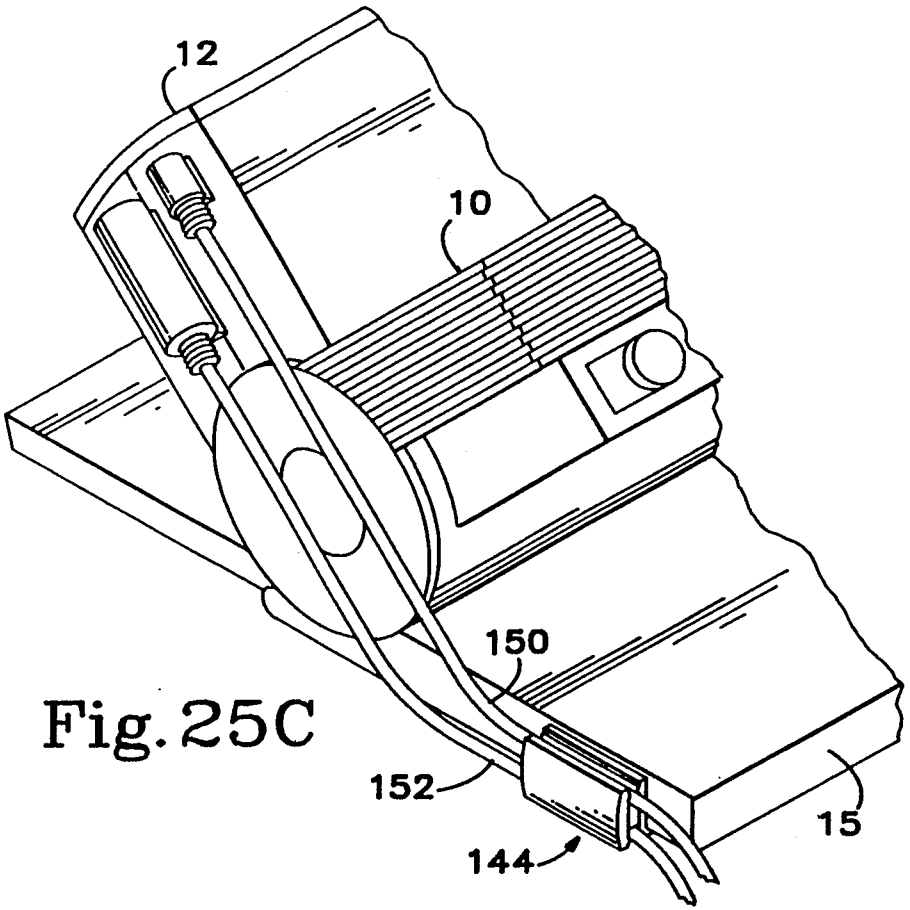
FIG. 25C is a perspective view of the printer and sheet feeder showing the clip of FIG. 25A mounted thereon.
Figure 25B:
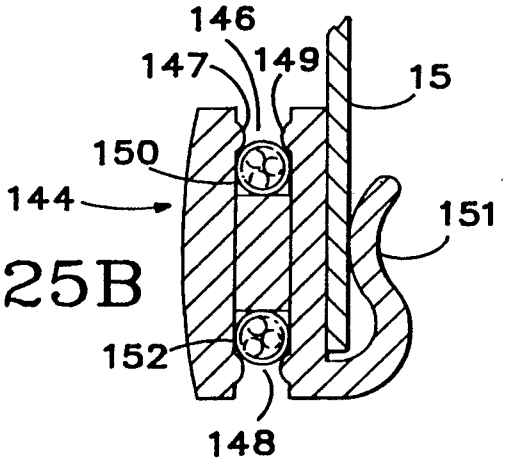
FIG. 25B is a view taken along line 25B—25B in FIG. 25A.
Figure 25A:
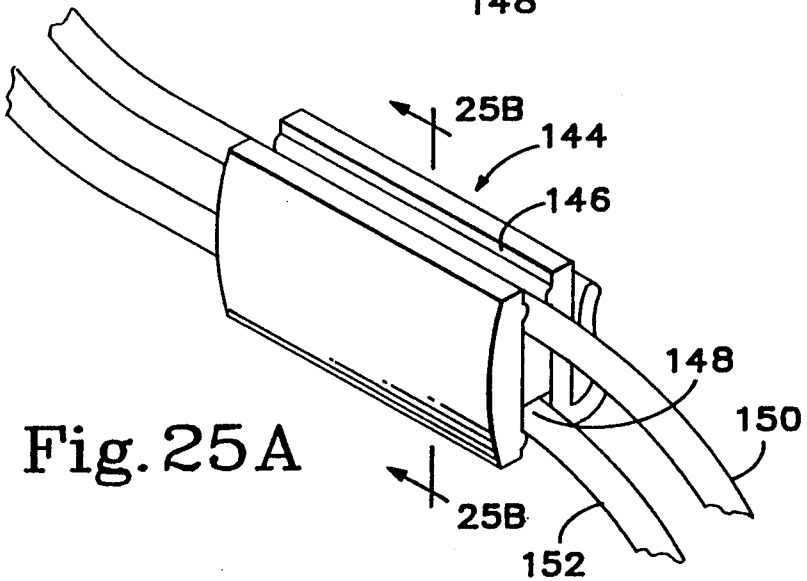
FIG. 25A is a view of the preferred embodiment of the printer and sheet feeder cable management system.

Looking now at FIG. 25A, illustrated therein is a preferred embodiment of a cable holder constructed in accordance with the present invention. Numbers corresponding to structure identified and described above are retained in the views of FIG. 25A–C. In FIG. 25B, channel 146 includes a pair of opposed hemispherical surfaces 147, 149 which face one another immediately above cable 150. It can be appreciated that surface 147, 149 retain a cable in the channel after it is pushed through the slightly-reduced portion of the channel formed by surfaces 147, 149.

Similar opposed hemispherical surfaces are formed in channel 148 and retain cord 152 therein. A clip 151 is formed on one side of cable holder 144 and can be used to clip the cable holder to base 15 as illustrated in FIG. 25C. Cable holder 144 has utility independently of being clipped to base 15 in that it serves to keep cables 150, 152 from becoming tangled and keeps them in a predetermined relationship to one another for reducing the area covered by cables 150, 152 adjacent the sheet feeder.

Figure 26:
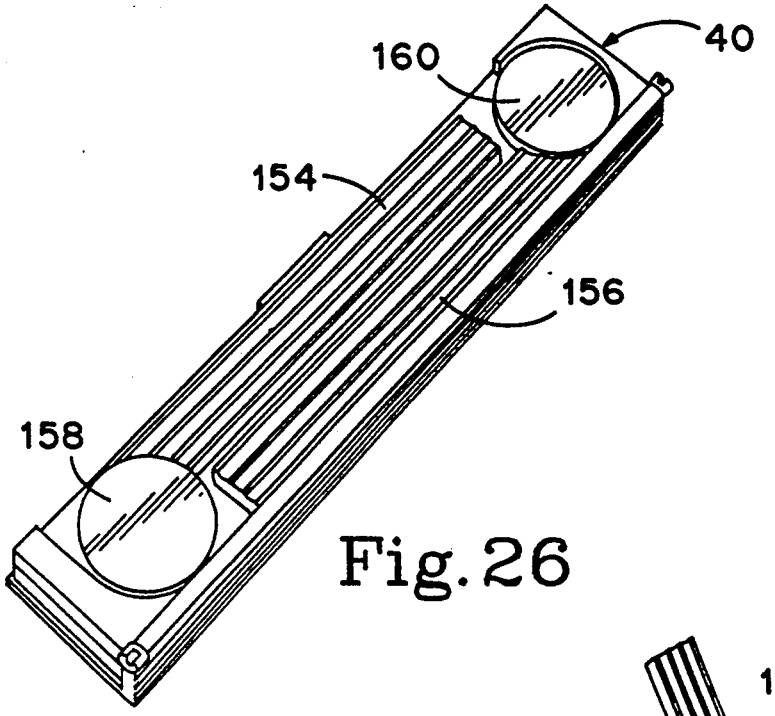
FIG. 26 is a perspective view of the paper access hatch with the paper support arms in their closed or nested positions.
Figure 27:
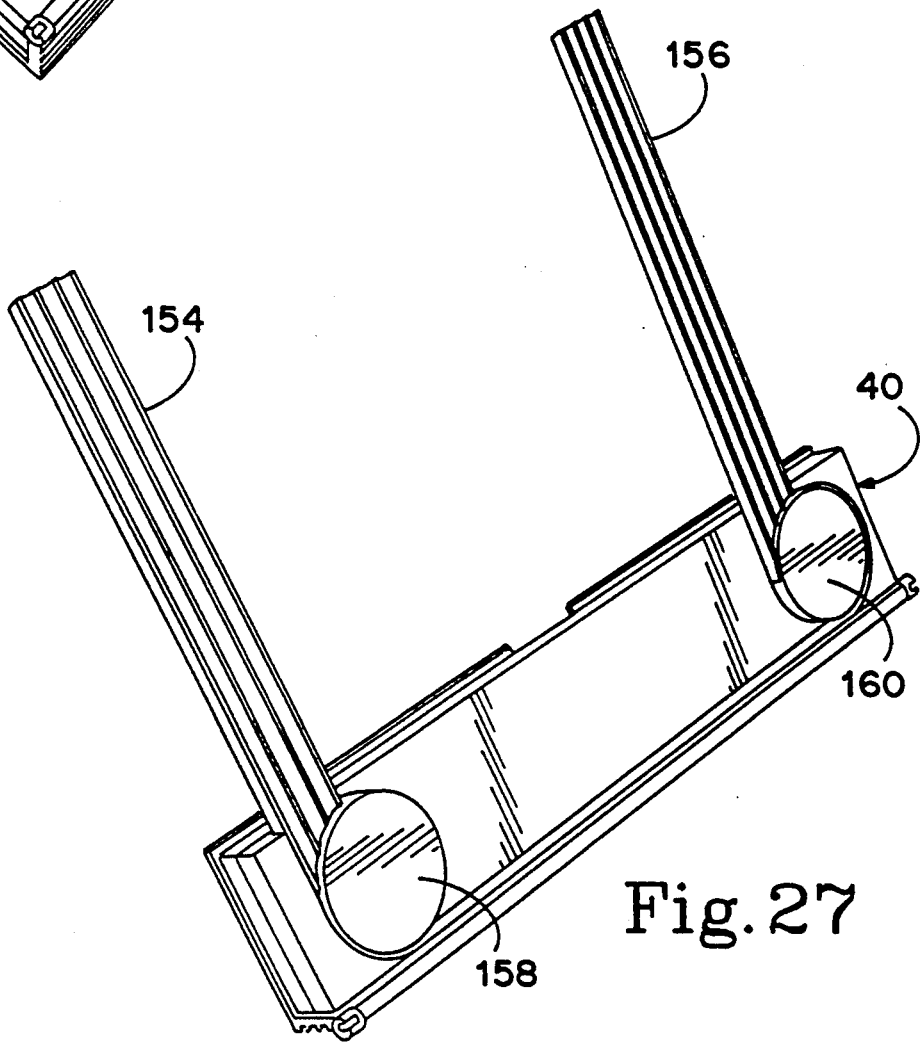
FIG. 27 is a perspective view of the paper access hatch with the paper support arms in their open or operational positions.
Figure 28:
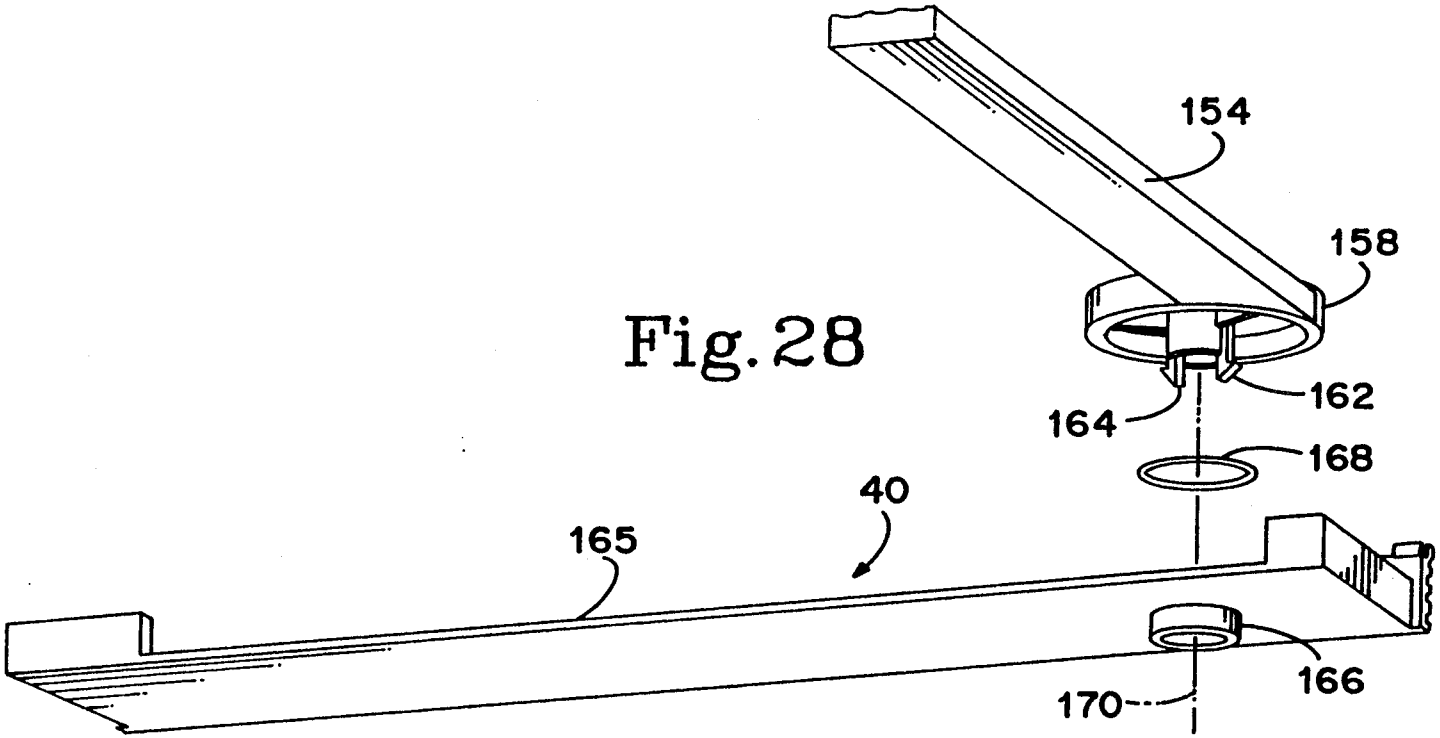
FIG. 28 is an enlarged exploded view of one of the paper support arms and paper access hatch.

Turning now to FIGS. 26–28, a pair of paper support arms 154, 156 each include a circular base 158, 160 which is integrally molded with arms 154, 156, respectively. Bases 158, 160 are pivotally mounted for rotation about their centers on the inside of paper access door 40. Considering now FIG. 28, illustrated therein is an exploded view, including the underside of base 158, which includes a pair of downwardly projecting arms 162, 164. Each of anus 162, 164 includes an upwardly projecting lip which engages a lower surface of an annular ring 166 formed on the underside of a top panel 165 of door 40. The bottom portion of door 40 is not shown in FIG. 28 to reveal annular ring 166.

Arm 154 can therefore be pivotally mounted on door 40 by inserting arms 162, 164 through an o-ring 168 and thereafter through an opening (not visible) in door 40 about which ring 166 is formed. The upwardly projecting edges on arm 162, 164 engage the lower surface of ring 166 and thereby mount arm 154 on the door for pivotal rotation about axis 170.

This structure permits easy removal and reinstallation of the arms. In addition, if force is inadvertently applied to one of the arms in a direction which tends to disconnect it from the door, the arm "pops" out of its connection without breaking and may thereafter be reinstalled as described above.

In addition, the arms pivot into a compact storage position, illustrated in FIG. 26, which permits closing of paper access door 40 to the configuration illustrated in FIGS. 3 and 4.

Figure 34:
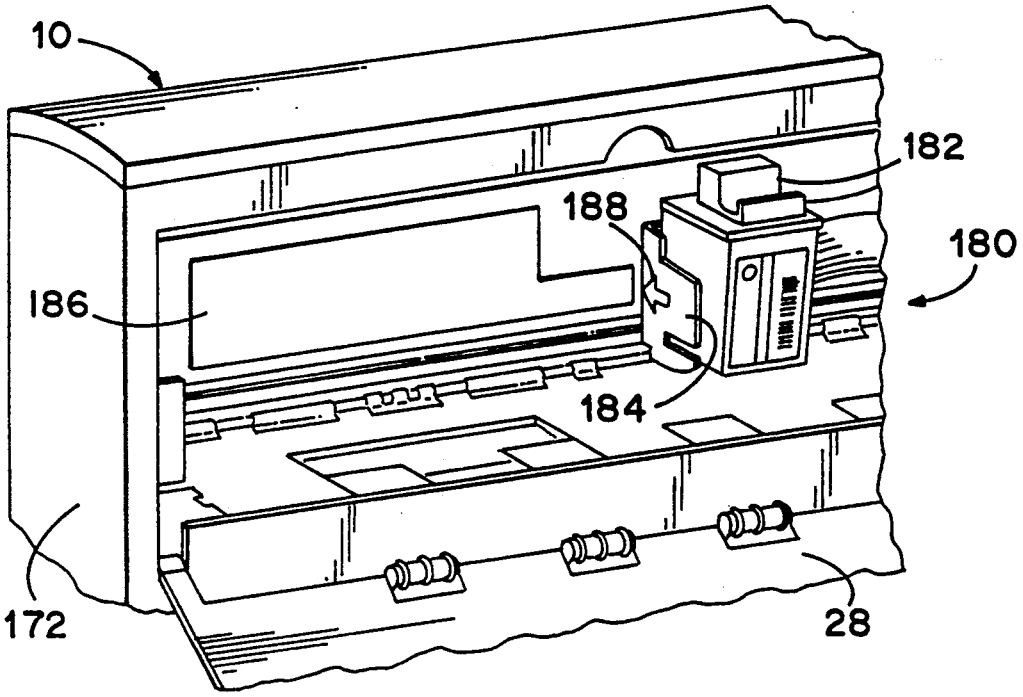
FIG. 34 is a partial perspective view of the printer of FIG. 1 with the pen access door open.

Turning now to FIG. 34, printer 10 includes a first portion or case 172 which houses the mechanical printer structure, such as the carriage and paper-handling components as well as electronic circuits which control the printer. Pen access door 28 is attached to case 172 via hinges, like hinges 176, 178, and pivots downwardly and toward the viewer in FIG. 34, to reveal an interior portion, indicated generally at 180, of the printer case.

Included in portion 180 is a conventional ink-jet cartridge 182. Cartridge 182 is mounted on a printer carriage (not visible) which is also referred to herein as a second portion of the printer. The carriage is driven by a motor (also not visible) and moves cartridge 182 generally from left to right as viewed in FIG. 1 in a known manner. Paper (not shown) exits case 172 via slot 30 (in FIG. 2) under control of paper-handling structure not relevant to the present invention. Cartridge 182 emits ink droplets in a known manner on the paper as it passes beneath the cartridge. Typically, the cartridge moves laterally to print a single swath across the paper, the paper advances, another lateral swath is printed, and so forth until an entire printed sheet emerges from the printer. Such printing techniques and circuitry for producing the same are known in the art.

A menu 186 comprises printed indicia formed on case 172 adjacent the travel path of cartridge 182. A pointer or arrow 188 is formed on cartridge holder 184 and points toward the lower portion of menu 186.

Figure 35:
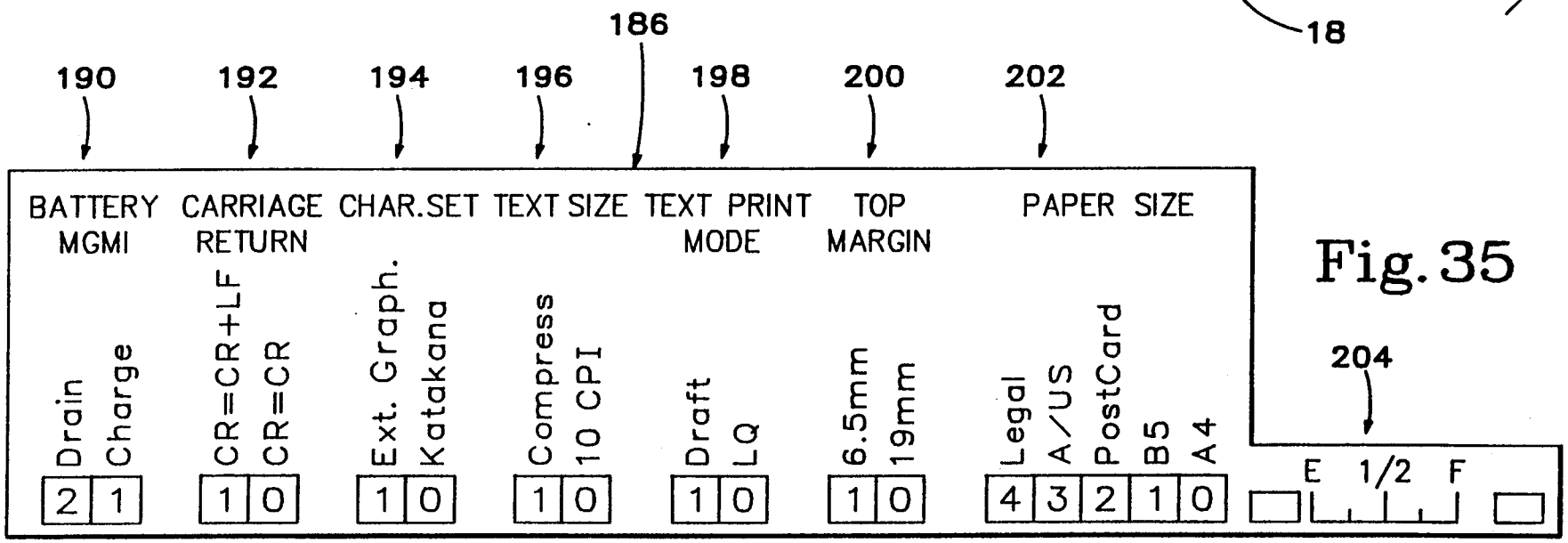
FIG. 35 is an enlarged view of the configuration menu of FIG. 34.

For more detail concerning menu 186 attention is directed to FIG. 35.

Menu 186 includes seven groups 190–202 of printer settings. Each of the settings is referred to herein as a configuration option. The configuration options may be selected, as will be discussed hereinafter, when the printer is placed in a configuration mode, also discussed hereinafter.

In the present embodiment of the invention, the printer can be powered by batteries. Group 190 presents configuration options of draining or charging the batteries. These functions are selectable only if a battery pack is installed in the printer. There is also an AC power adapter (not shown). When the power adapter is installed only the charge function is selected. When the power adapter is not connected to the printer, only the drain function can be selected.

The printer starts the drain or charge function when the printer is switched from the configuration mode to its normal operational mode as discussed hereinafter.

Carriage return group 192 permits definition of the carriage return control character as between carriage return (CR) only or between carriage return (CR) and Line Feed (LF). Each of the configuration options in groups 190–202 is identified with a numeral. Configuration options identified with the numeral zero are the factory default settings.

Character set group 194 permits selection of a default character set. The present embodiment of the invention is selectable between Katakana and the extended graphics character sets.

Text size group 196 permits selection of character pitch between a normal character pitch (10 characters per inch) and compressed character pitch (17 characters per inch). Text print mode group 198 includes selection between letter quality (slower speed printing) and draft quality (higher speed printing). Top margin group 200 selects a top margin on printed documents of either 19 mm or 6.5 mm.

Paper size group 202 permits selection of paper size as indicated on the labeling of each option in group 202.

A battery charge indicator 204 provides a scale which reflects the condition of printer battery pack as will shortly be described.

Figure 36:
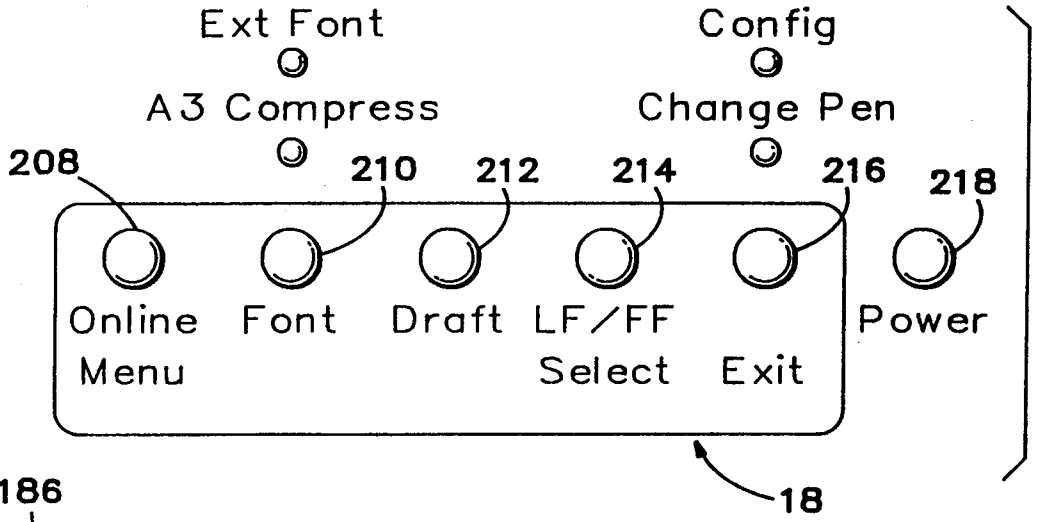
FIG. 36 is an enlarged view of control panel buttons mounted on the printer of FIG. 1.

Turning now to FIG. 36, indicated generally at 206 is a control panel which includes a plurality of buttons 208–218. Some of the buttons have lights, indicated by circles above the button, associated therewith. In normal-operation mode, buttons 208–216 are operable to perform functions associated with the printer, e.g., button 212 switches between draft and letter quality printing. Each of buttons 208–216 assumes control functions different than when the printer is in normal operational mode, i.e., prior to entering configuration mode. Prior to description of the manner in which the printer is placed into configuration mode, and the operation of the printer in that mode, attention is directed to FIG. 37 for description of additional structure.

Indicated generally at 220 is a schematic diagram of a portion of printer 10. Buttons 208–216 are represented by boxes bearing labels which correspond to the button function in configuration mode and identified with the same numeral as the corresponding button in FIG. 35.

Buttons 208–216 provide input signals to carriage control firmware which provides control signals to the previously mentioned motor for driving the print carriage. The firmware along with circuits for determining absolute carriage position are referred to herein collectively as system 222. For the most part system 222 comprises conventional printer carriage control circuitry some of which is implemented as a computer program that is permanently stored in the printer. System 222 provides an output to the carriage motor, identified schematically as motor 224, which provides the drive power for the motor. A shaft encoder 226 is mounted on the output shaft of motor 224 and provides signals to system 222 that indicate the number of shaft rotations and therefore the position of the print carriage. Such signals are processed by known circuitry in system 222 and are used by the carriage control firmware to accurately move and position the print cartridge.

Also included therein is a computer program implemented in firmware constructed in accordance with the present invention. The program is operable when the printer is in the configuration mode and causes the printer to operate in the manner which is described in the description of the operation of the present embodiment of the invention hereinafter. A person having ordinary skill in the art to which the invention relates in conjunction with the description contained herein, including FIG. 37, can write computer code to cause operation of the computer as described.

FIG. 22 shows a perspective view of the output paper path apparatus. The apparatus includes a generally planar output platform 300 formed on base 15. A pair of deflector wings are coupled to the output platform 300. These include a left deflector wing 3 1 0 and a right deflector wing 320. Left and right are defined in the context of facing the access door 28 from the output platform. An edge separator 330 also is coupled to output platform 300 and positioned adjacent to the paper exit slot 30.

Figure 29:
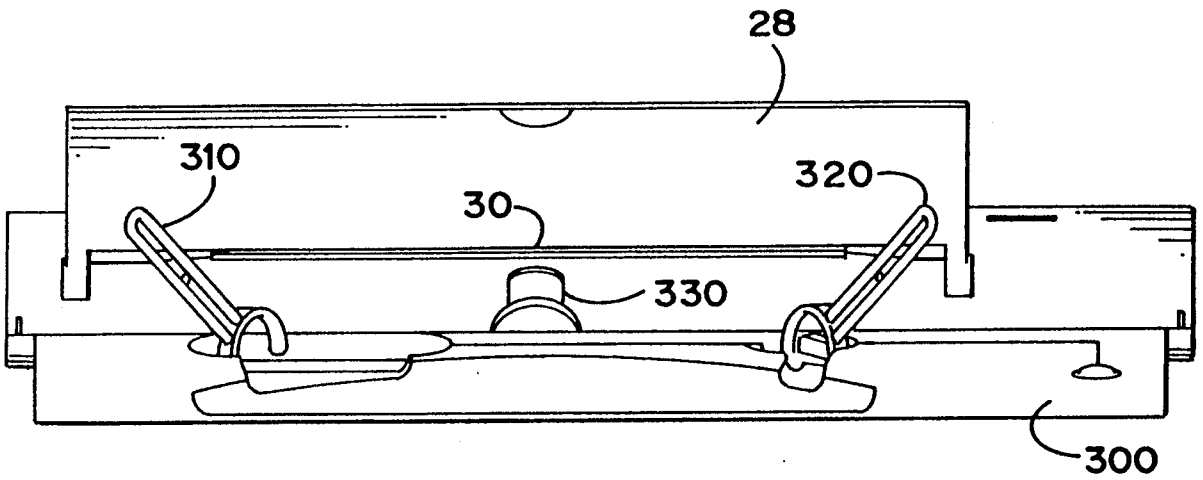
FIG. 29 is a partial perspective view of the printer system viewed from an output platform (formed on the base) toward the paper exit slot.

FIG. 29 is a front elevational view of the apparatus of FIG. 22. As appears in this figure, the deflector wings 310, 320 are spaced apart from each other, and each of them is inclined laterally, i.e., toward a respective outside edge of the output platform. Additionally, each of the deflector wings is inclined forwardly, as best seen in the side elevation view of FIG. 23. Forward in this description is defined as the direction of paper movement through the printer 10 during printing.

The edge separator 330 is roughly centered relative to the paper exit slot 30. It also is forwardly inclined. FIGS. 30A–D illustrate the preferred embodiment of edge separator 330. Separator 330 includes a substantially planar semicircular portion 331 which is mounted on a shaft 332 for pivoting action as shown by the arrow on portion 331 in FIG. 30D. A recess 332 formed in base 15 receives portion 331 when it is pivoted to its lowermost position as shown in FIG. 30A.

A flexible polymeric sheet 333 is mounted on and extends from portion 331 as shown. In the lowermost position of the edge separator, sheet 333 is substantially flush against base 15. A spring 334 biases portion 331 into the upper position illustrated in FIGS. 30B and 30D. When the printer and sheet feeder are secured to base 15 in the transport/storage mode as described elsewhere herein, portion 331 pivots downwardly to permit the printer to assume the configuration of FIGS. 3–8. Flexible polymeric sheet 333 flexes as paper is urged thereagainst when it emerges from the printer as illustrated and described herein in connection with the operation of the present embodiment of the invention.

Figure 30:
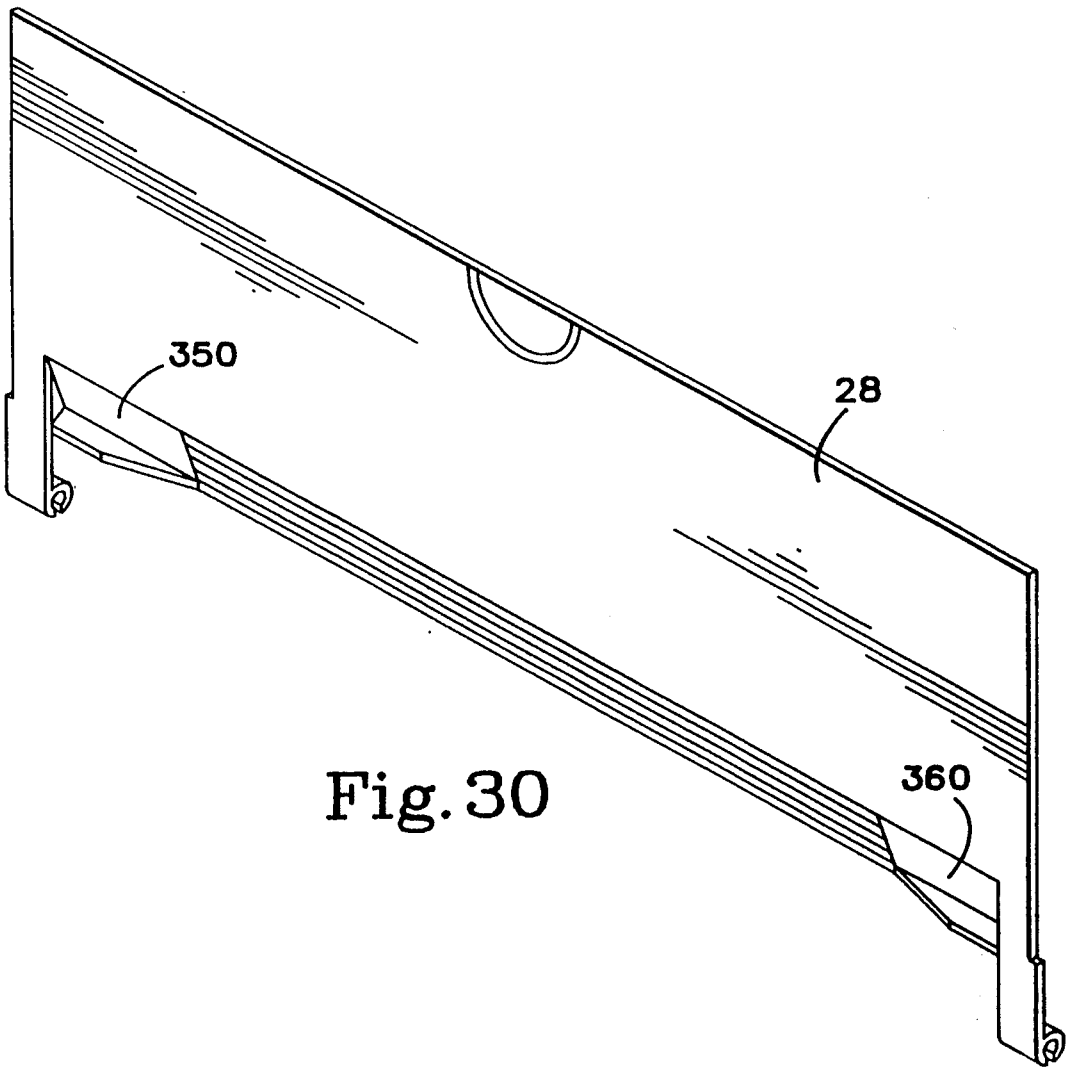
FIG. 30 is a perspective view of the pen access door showing detail of the trap pockets.
Figure 30A:
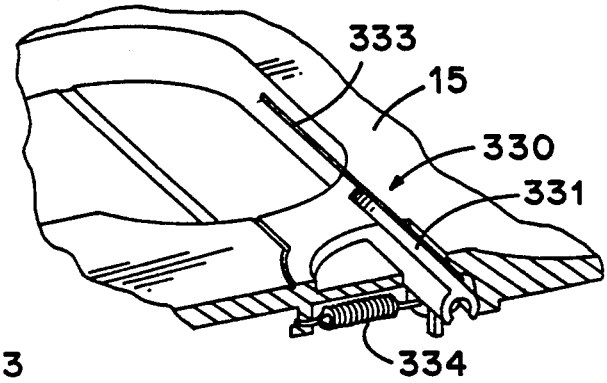
FIGS. 30A, B, C and D are perspective views of the edge separator.
Figure 30B:
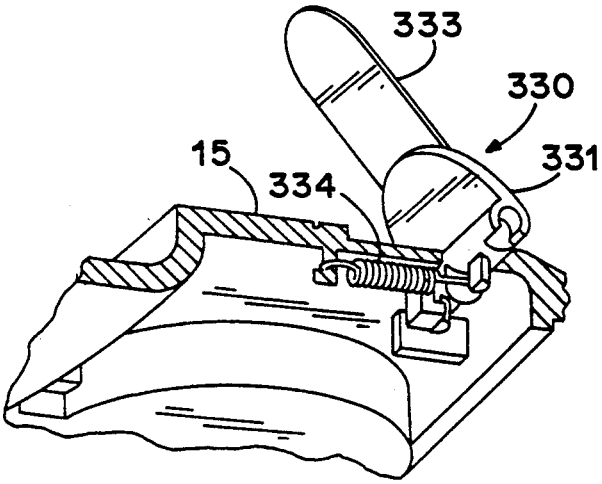
Figure 30C:
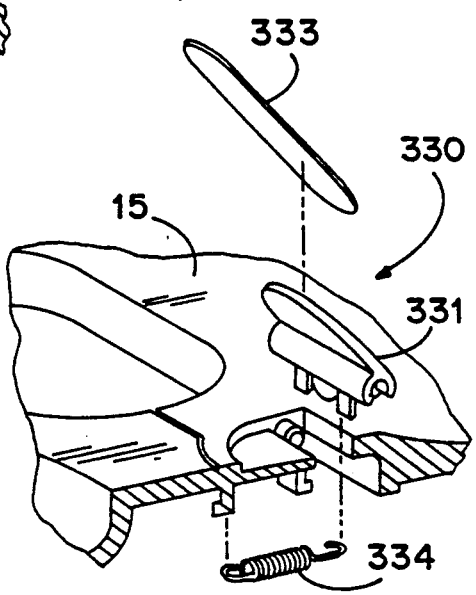
Figure 30D:
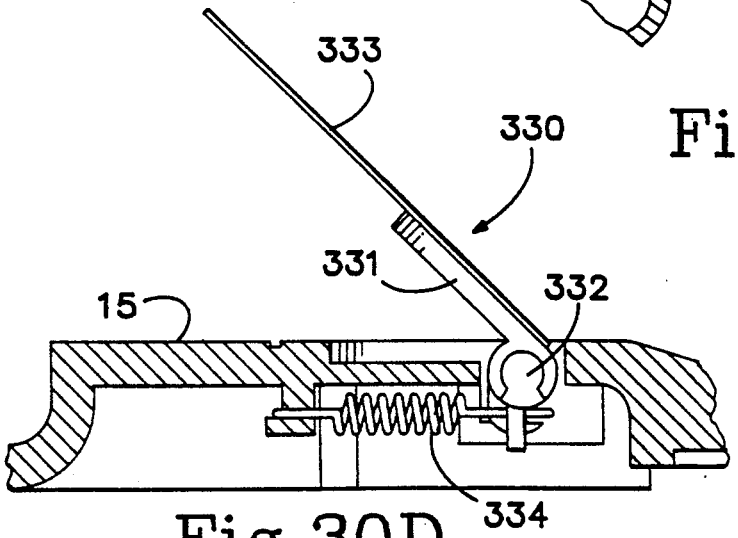

Referring now to FIG. 30, the pen access door 28 includes a left trap pocket 350 and right trap pocket 360 for receiving the respective trailing edge comers of a printed sheet after it exits the paper exit slot, as further explained below.

Figure 31A:
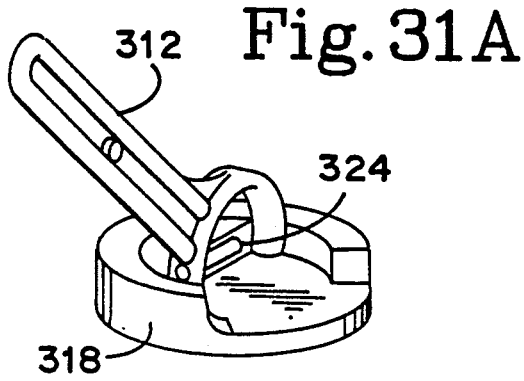
FIGS. 31A, B and C show detail of the deflector wings.
Figure 31B:
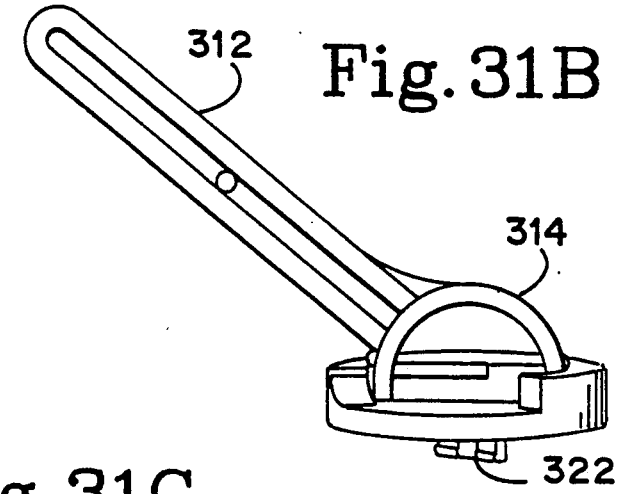
Figure 31C:
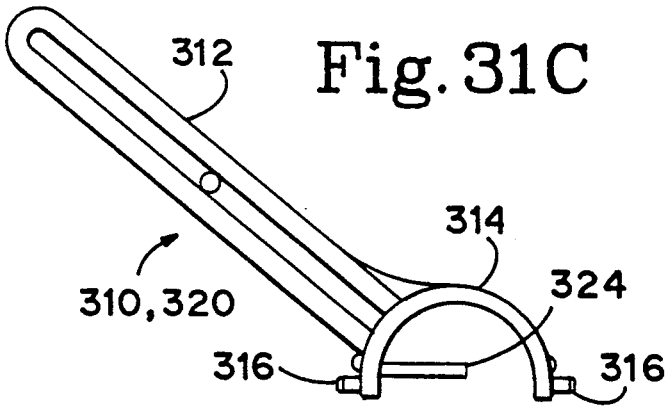

FIG. 31C shows detail of the deflector wings 310, 320. The deflector wing itself is shown in side elevation in FIG. 31C. The right wing 320, for example, includes an elongate portion 312 fixed to a base portion 314. The deflector wing preferably is formed of a plastic material for lightweight and economical construction. The base portion 314 includes a pair of mounting pins 316 for snapin connection to corresponding mounting holes on the output platform 300 or on a slider, in the case of the left deflector wing, described below.

The left deflector wing is illustrated in FIGS. 31A and 31B. The left deflector wing further includes a slider portion 318. The slider 318 is movably connected to a corresponding channel in the output platform 300 so as to permit lateral positioning of the left deflector wing in order to accommodate printed media of various widths. The slider 318 is connected to the output platform by means of a suitable snap-in hook 322.

As described above, the printing system may be configured into a travel mode in which the output platform 300 and the output side of the printer 10 are closed into parallel proximity with each other. For that reason, the deflector wings, as well as the edge separator, are pivotally connected to the output platform and arranged to fold down into a travel position, substantially flush with the output platform. For that reason, the deflector wings include torsion springs arranged to urge the deflector wings upward toward an operational position for use, while allowing them to pivot down into the travel position automatically. A suitable stop is provided so that the deflector wings as well as the edge separator automatically spring upward into a predetermined position for use when the printer is configured in the automatic feed mode.

Consideration will now be given to the manner in which printer 10 and sheet feeder 12 operate. First, as previously mentioned, printer 10 may be operated in a stand alone mode as depicted in FIG. 1. Printer stand 32 is rotated from the view of FIG. 2 to provide a stand for maintaining the printer in the position of FIG. 1. The printer may be run on battery power or an AC adaptor (not shown) is inserted in socket 34. A conventional printer cable from a commercially available computer is plugged into port 26 to provide image and text data to the printer in a known manner.

Prior to beginning printing, the printer is configured to select configuration options listed on menu 186 and described above. Access door 28 is opened to reveal menu 186 and cartridge holder 184 as shown in FIG. 34. Next, the printer is placed in the configuration mode by pressing button 216 and holding the same in a depressed condition until the light labeled "config" begins flashing. Once the light flashes the button is released and the printer is in configuration mode. If the printer is operating under battery power the carriage motor drives arrow 188 to battery charge indicator 204 to indicate the level of remaining charge in the battery. The printer includes conventional structure for measuring battery voltage and also includes a program for counting the number of pages and lines printed by the printer using battery power. A signal is developed, based on the number of pages and lines printed and the measured battery voltage, which is proportional to the remaining charge left in the battery. The signal is provided to system 222 which drives carriage motor 224 to the appropriate position opposite battery charge indicator 204.

When in the configuration mode, clicking button 208 moves the configuration pointer to the current setting in the next group to the left of the current group. Once within the group, buttons 212, 214 are used to move the pointer to the left and right, respectively, to select different options within the group. If the pointer is in the left-most setting, clicking button 212 moves the pointer back to the first setting in the group. Similarly, if the pointer is at the right-most setting clicking button 214 moves the pointer to the last setting in the group. Once the pointer is on the desired configuration option within a group, button 210 is clicked to select the option in which the pointer is pointing. After each group is configured as described above, button 216 is clicked to exit the configuration mode and return to normal operation.

Figure 37:
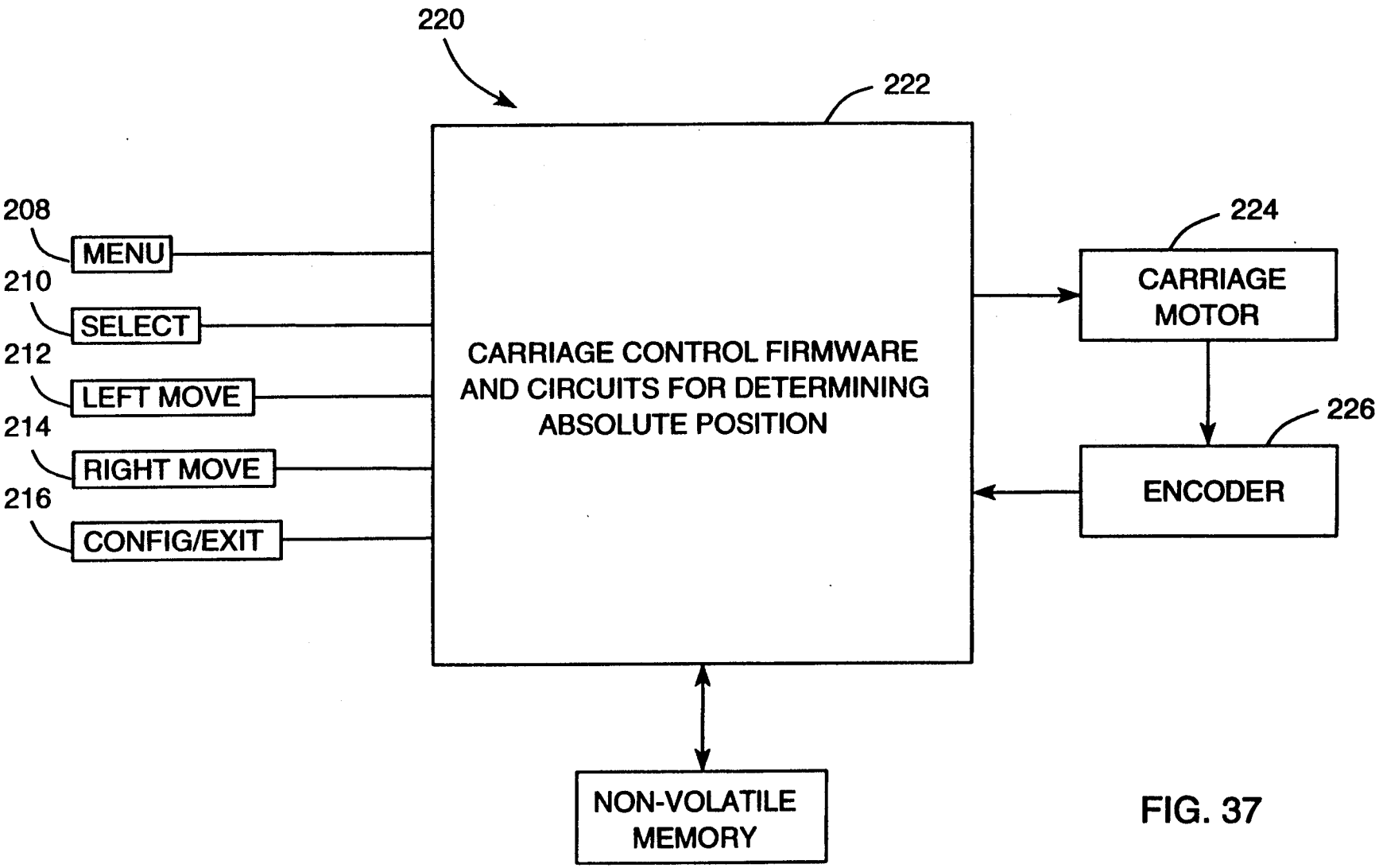
FIG. 37 is a schematic diagram of the control circuit including a computer program constructed in accordance with the present invention.

The current configuration settings are stored in the non-volatile memory in FIG. 37. Each time power is supplied to the printer the settings are used as the default settings. The settings in group 190 relate to the battery. The option can be set either to "charge" or "drain." These are selectable only if a battery is installed in a printer. If an AC power adaptor is connected to the printer as described above, only the "charge function" can be selected. If the power adaptor is not connected to the printer, only the drain function can be selected which completely discharges the battery. The printer starts the drain or charge function, whichever is selected, when configuration mode is exited as described above.

Once the printer is configured, manual printing is commenced. The computer (not shown) to which the printer is connected via cable 152 (in FIG. 25) instructs the printer to print a job. A user then inserts paper, one sheet at a time, into slot 22 where it is grabbed by rollers in a known fashion and pulled, in a straight path, beneath ink-jet cartridge 182 as it traverses the width of the paper. The printed sheet emerges from paper exit slot 30 on the other side of the printer. Additional sheets are inserted, one at a time, via slot 22 until the printing job is complete.

Figure 21:
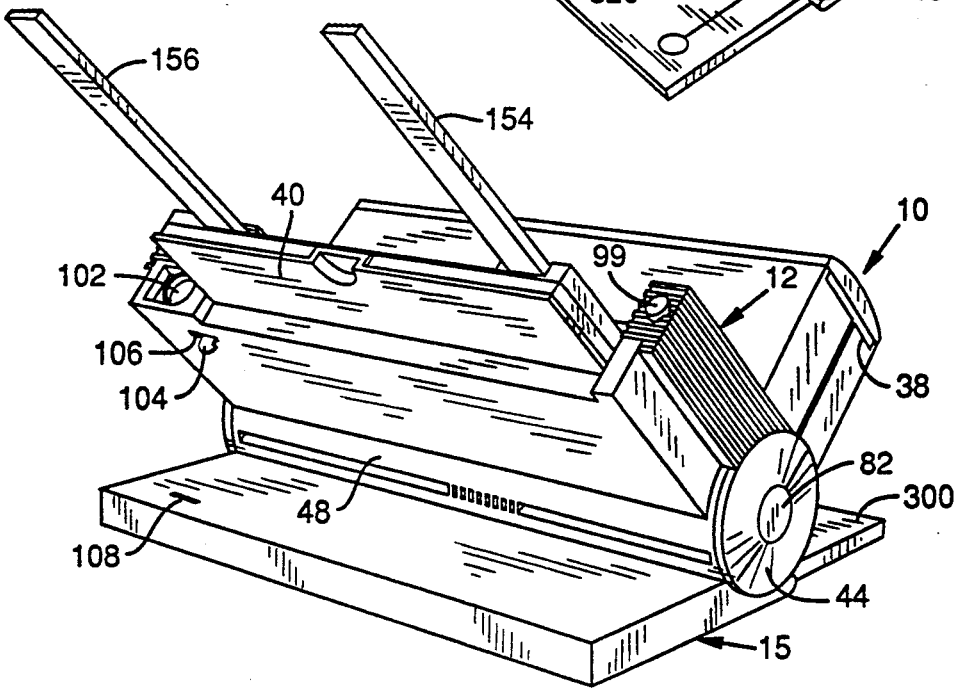
FIG. 21 is a rear perspective view of the printer and sheet feeder of FIG. 20.

When the printer is used in conjunction with sheet feeder 12 and base 15, it is stored and transported in the configuration illustrated in FIGS. 3–8. In this configuration, tongue 94 is received in slot 92 (FIGS. 13 and 15) and sheet feeder 12 is locked to the base due to the hook on the lower end of 106 being engaged with slot 108 (FIG. 21). Also, spherical engagement lock 116, in FIGS. 19A–C prevents lateral movement of the printer relative to the base. The sheet feeder, printer and base are thus locked together in a manner which prevents any relative movement.

Figure 20:
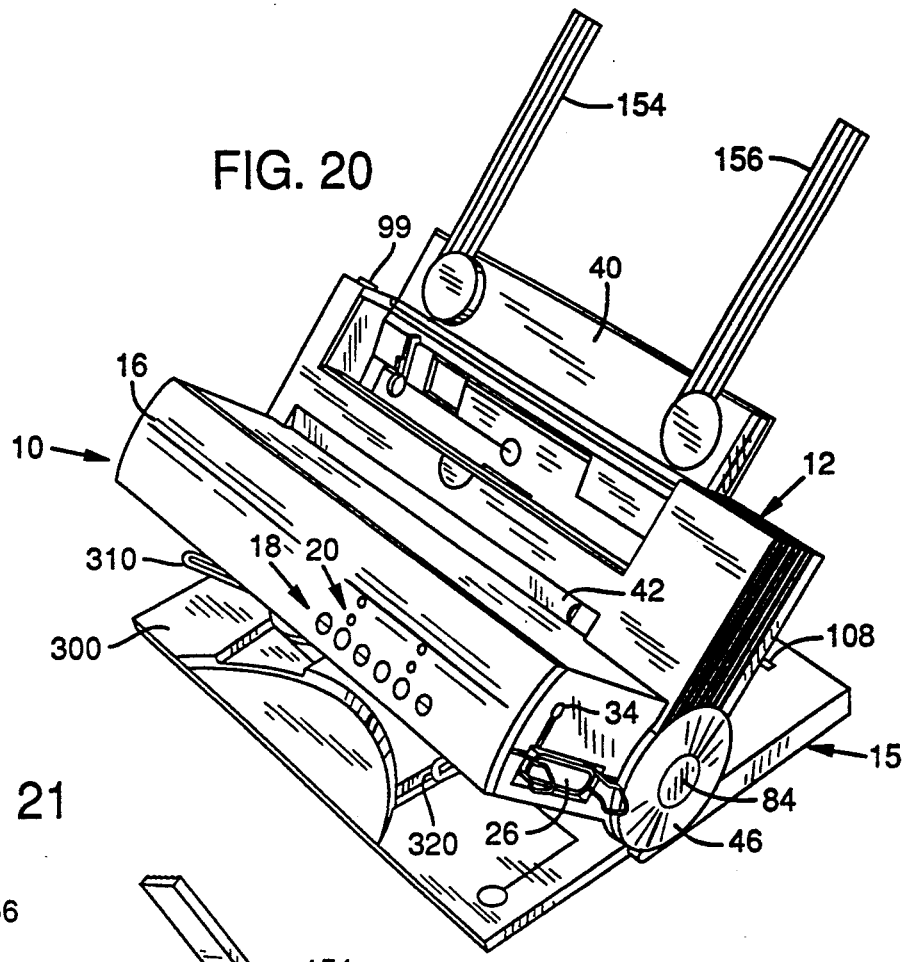
FIG. 20 is a front perspective view illustrating the printer and sheet feeder in an operational mode in which the paper access hatch is open and the paper support arms are in their open or operational positions.
Figure 23:
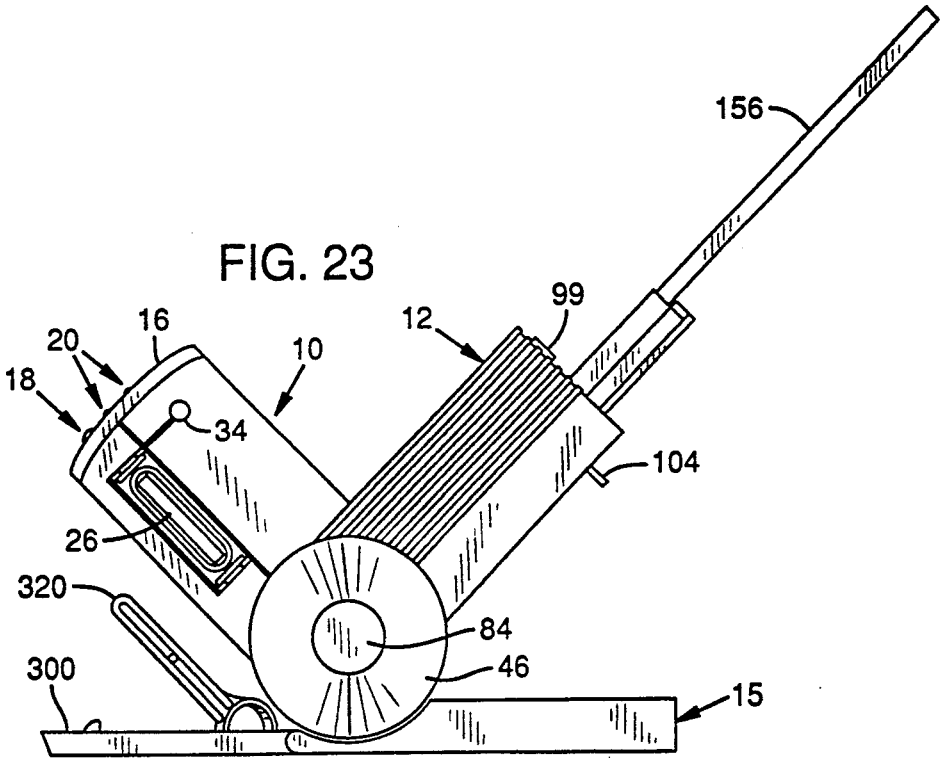
FIG. 23 is a right side view of the printer and sheet feeder in the operational mode of FIGS. 20 and 21.
Figure 23A:
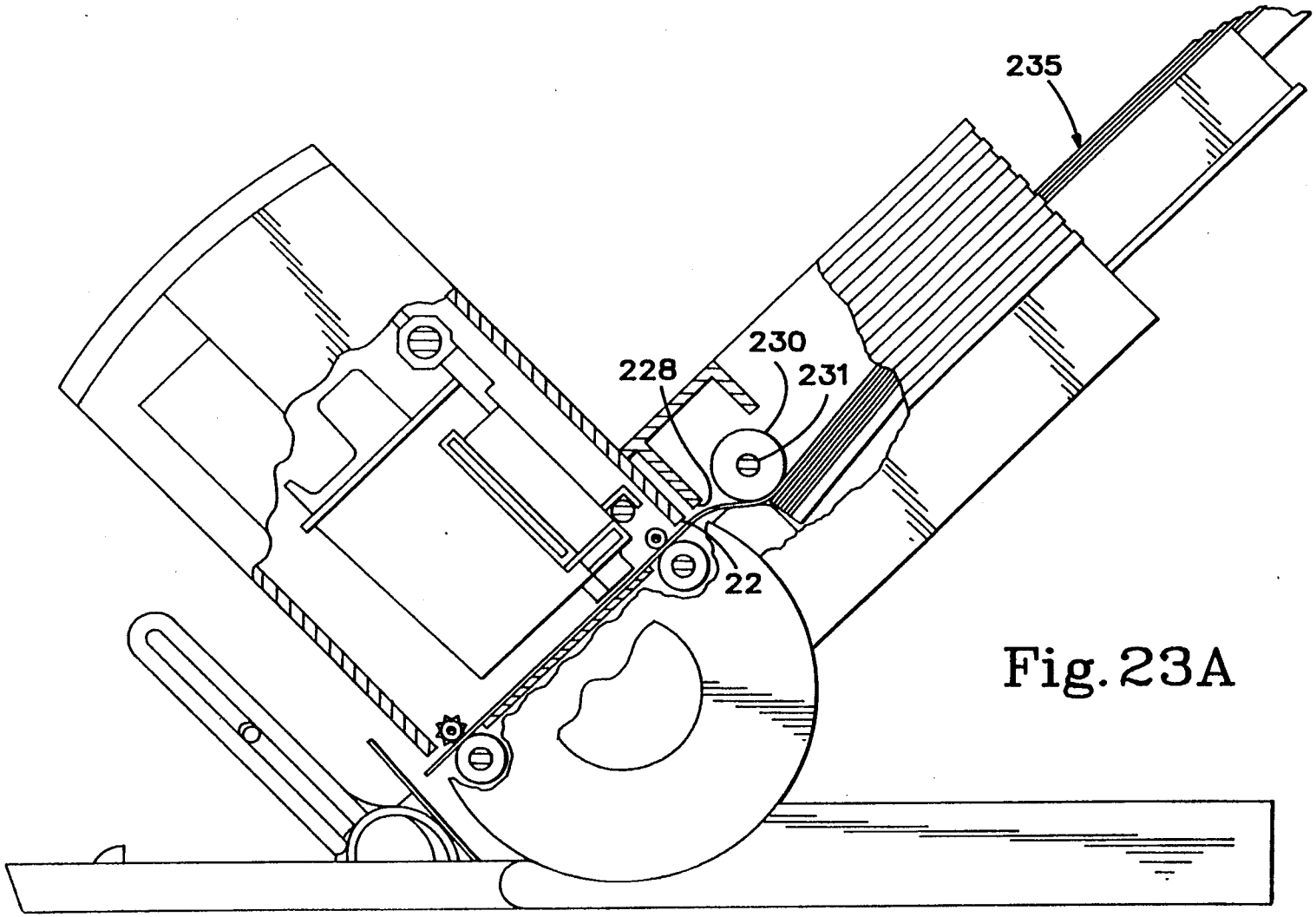
FIG. 23A is a view similar to FIG. 23 with portions broken away to illustrate the paper feed path.
Figure 23B:
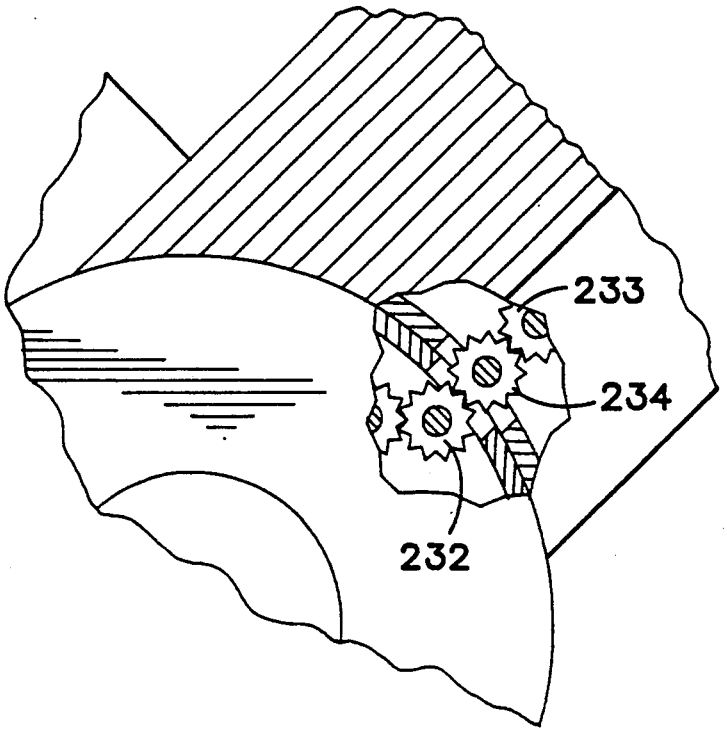
FIG. 23B is a partial view of the printer and sheet feeder of FIG. 23A with different portions broken away to illustrate the linkage between the paper feeder motor in the printer and the paper feed mechanism in the sheet feeder.
Figure 38:
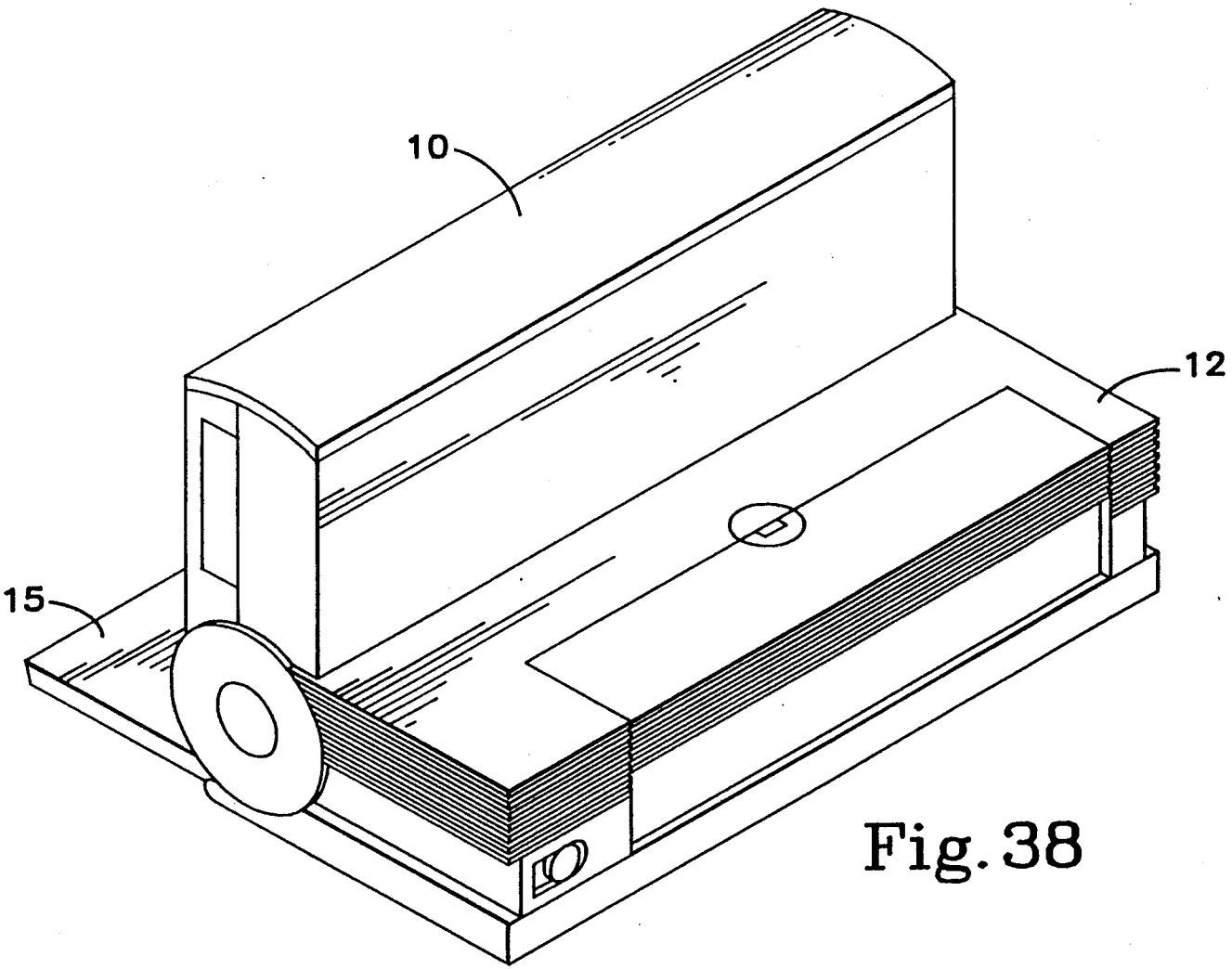
FIG. 38 is a perspective view of the printer and sheet feeder configured for automatic sheet feeding with a straight paper path.

Printer 10 may be configured for automatic sheet feeding in one of two modes. To provide automatic sheet feeding for printing in a straight paper feed path, button 102 is slid as indicated in FIG. 21 thereby withdrawing tongue 94 from groove 92. Next, printer 10 is rotated until it is oriented at 90° relative to sheet feeder 12, as viewed in FIG. 38, the button is released and tongue 94 is received in slot 90 thereby locking the sheet feeder and printer in the configuration of FIG. 38. When so configured, a slot 228 (in FIG. 23A) in the sheet feeder is directly opposite slot 22 on printer 10. Both slots are concealed from view when configured as in FIG. 38. Door 40 is opened as shown in FIGS. 20 and 21 and the paper support arms are extended. Paper is then loaded into sheet feeder 12 so that lower end thereof is adjacent pinch rollers 230 (in FIG. 23A) contained in the sheet feeder. A button 99 (in FIGS. 21 and 23) releases rollers 230 to permit a stack of paper 235 to be inserted thereunder. After paper is inserted the roller is urged into the configuration of FIG. 23A. It should be noted that a motor (not visible) contained in printer 10 drives a gear 232 (in FIG. 23B) which engages with a corresponding gear 234 (FIG. 23B) in the sheet feeder when the feeder and printer are oriented at 90° relative to one another. Gear 234 is connected by a conventional gear train 233 (partially visible) to shaft 231 for driving roller 230. The sheet feeder motor is driven in accordance with known techniques for advancing paper from a sheet feeder, one sheet at a time, to a printer.

With the printer configured as shown in FIG. 37, automatic sheet feeding occurs in a manner which maintains a straight paper feed path, ideal for jobs in which the paper is stiff and/or in which dense graphics or text is being printed. To configure the printer from the storage/transport configuration of FIGS. 3–8 to another automatic feeding mode, button 102 is again slided to withdraw the tongue from housing 48 and to release sheet feeder 12 from base 15 by unhooking the hook on the lower end of lug 104 from slot 108. The sheet feeder is then rotated 90° until tongue 94 is received in slot 90. When so received sheet feeder and printer are locked at 90° relative to one another. Thereafter, both units are pivoted about the axis of module 48 until the springs in base 15, like spring 86, engages slot 88 thereby maintaining the configuration shown in FIGS. 20, 21, 23 and 23A. Door 40 is again opened and arms 154, 156 are extended. Also, wings 310, 320 are moved to the configuration shown in FIGS. 22 and 23. When printing begins, a sheet with wet ink thereon emerging from slot 30 is prevented from falling on a previously printed sheet in a manner which will be shortly described.

Finally, in a third mode, manual printing is achieved with printer 10 and sheet feeder 12 connected to base 15. To move into this manual printing configuration, button 102 is slided to withdraw the tongue from housing 48 thereby permitting pivotal movement of printer 10 about the axis of the power housing module. The printer is pivoted upwardly until it assumes the configuration of FIG. 22. At this point, springs, like spring 86 are received in slot 88 thereby holding the printer at about a 45° angle relative to base 15. Tongue 94 is not received in a slot but rather bears against an exterior surface of housing 48. In this position, alignment guide 42 is used to align paper for feeding the same into slot 22 which is exposed when the printer and sheet feeder are in the configuration of FIG. 22.

Consideration will now be given to the manner in which deflector wings 310, 320 prevent a sheet emerging from a printer from immediately landing on the preceding sheet which may still have wet ink thereon. This feature is operable both in the manual printing mode of FIG. 22 and in the automatic sheet feeding mode illustrated in FIG. 23.

Operation

In operation, the edge deflector 330, deflector wings 310, 320, and the left and right trap pockets 350, 360, respectively, cooperate so as to prevent a printed page from contacting a previously printed page as long as possible.

Figure 39:
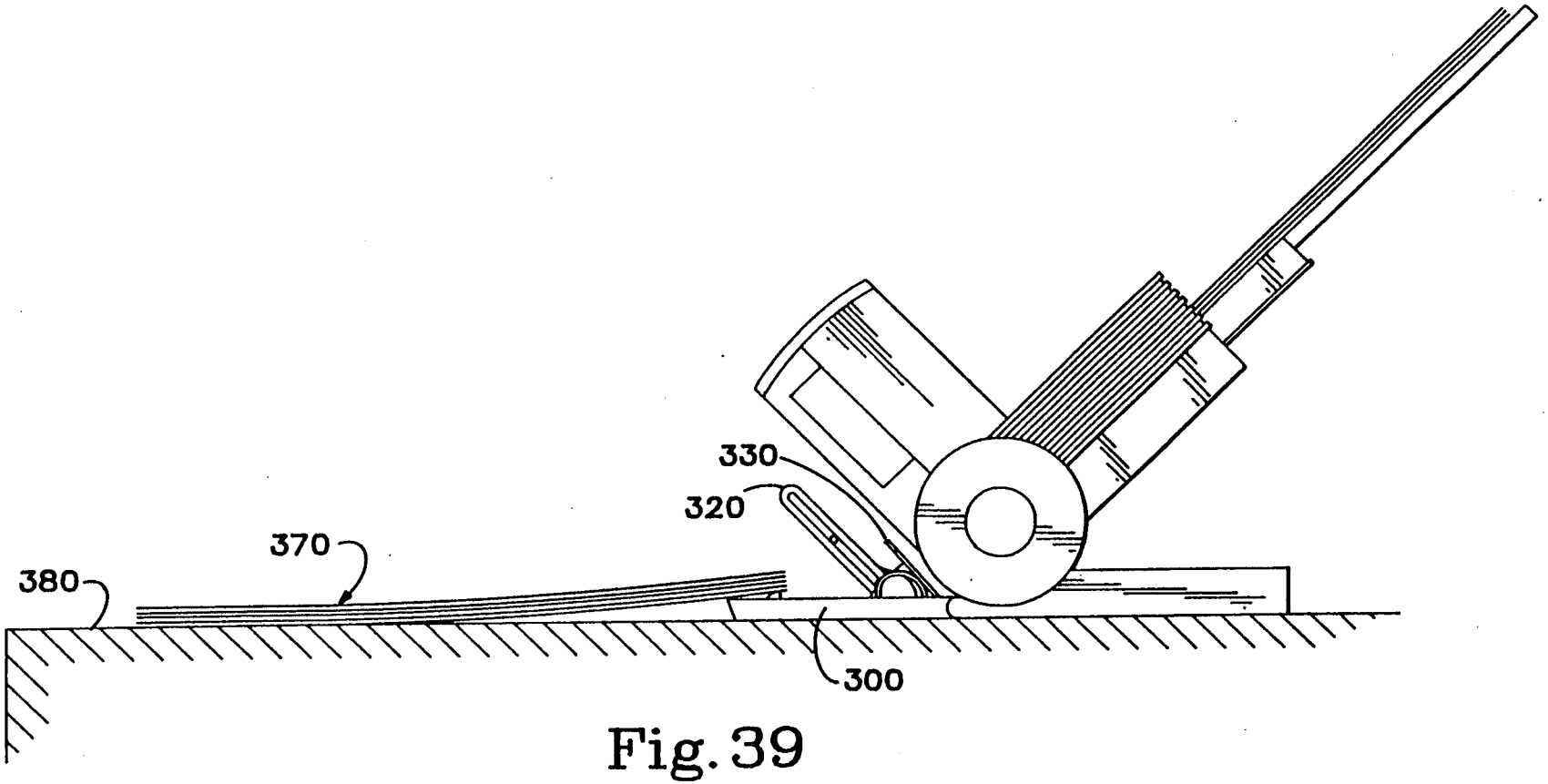
FIG. 39 is a side view of the printer system showing printed pages stacked on the output platform.

Referring now to FIG. 39, the printer apparatus is shown supported on a horizontal surface 380, along with a stack of previously printed media 370. The processing can be described in the following stages:

Stage 1—Printing and Deflecting

A sheet of printable media, such as paper or an overhead transparency, is fed into the printer by sheet feeder 12.

Figure 40:
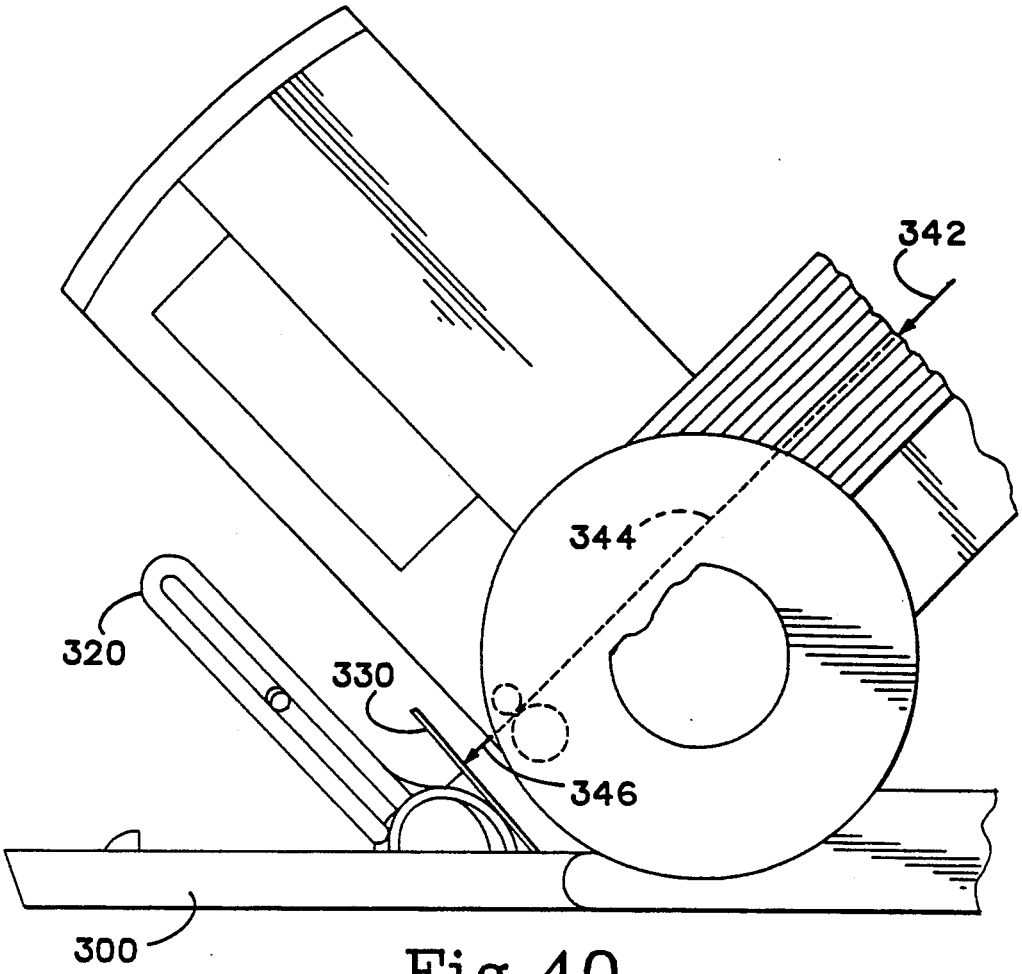
FIGS. 40, 41, 42, 43, 44 and 45 are side elevational views of the wet paper path handling system further illustrating the progress of printed media from initial exit through the paper slot through stacking onto the output platform.

Referring to FIG. 40, a sheet of media to be printed is fed into the printer in the direction indicated by arrow 342. The paper proceeds through the printer along a print path indicated by dashed line 344. Finally, the paper exits the printer through the paper exit slot 30 indicated by arrow 346 on the output side of the printer. As indicated in FIG. 40, the leading edge of a media first contacts the edge deflector 330.

Figure 41:
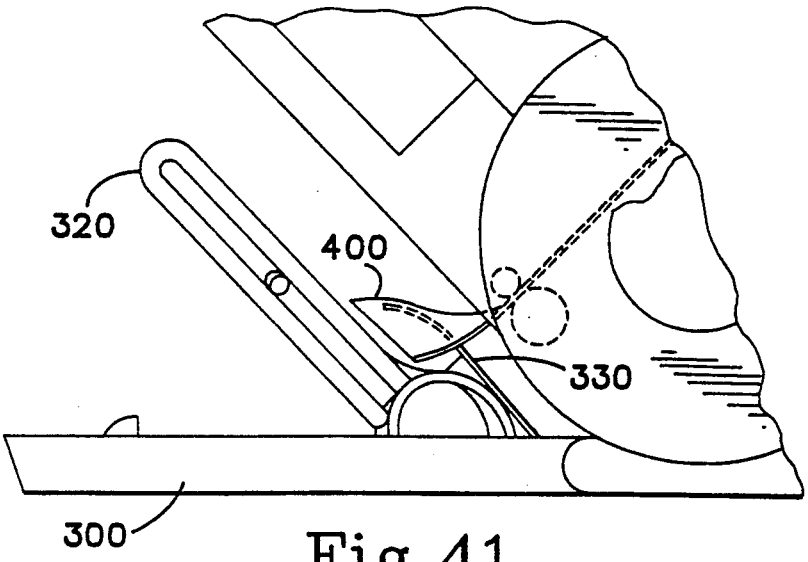

Referring now to FIG. 41, the edge deflector 330 deflects the leading edge of the paper generally upward as it deflects downwardly. The paper is indicated by reference 400.

For reference, the media may be described as having a leading edge, referring to the edge of the paper first to exit the printer. The edge of the paper last to leave the printer is called the trailing edge. The paper also includes lateral edges, which may be referred to as left and right edges, again defined viewing the printer from the output side.

Stage 2—Printing and Deflecting

Figure 42:
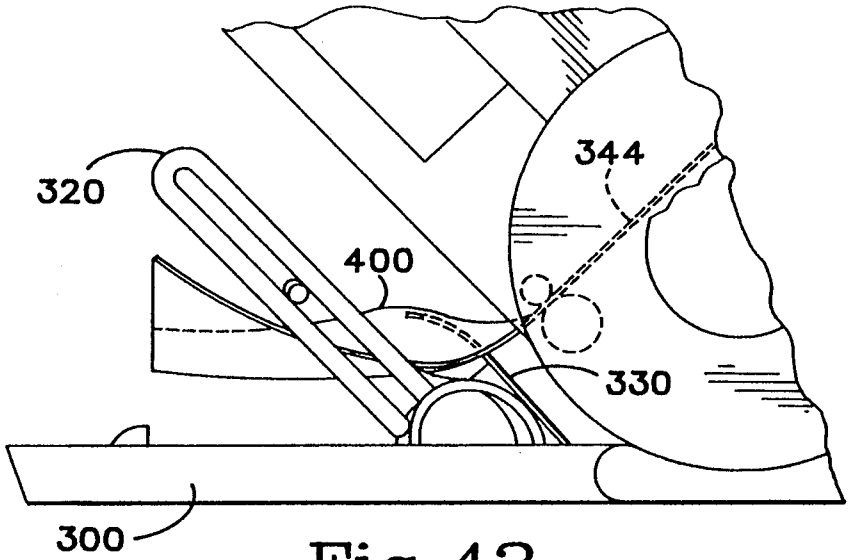

Referring now to FIG. 42, as the media 400 travels further out of the paper exit slot, the leading edge next contacts the left and right deflector wings 310, 320. The left deflector wing 310 is obscured in this right side view. In general, it is arranged symmetrically with respect to the right deflector wing as further explained below.

As media 400 moves further along, the deflector wings deflect the lateral edges of the media upward, thereby imparting a laterally bowed-shape to the media. This serves to stiffen the media so that, even as the leading edge moves well beyond the deflector wings, the stiffened paper holds itself up off the output platform 300.

Stage 3—Stiffening

Figure 43:
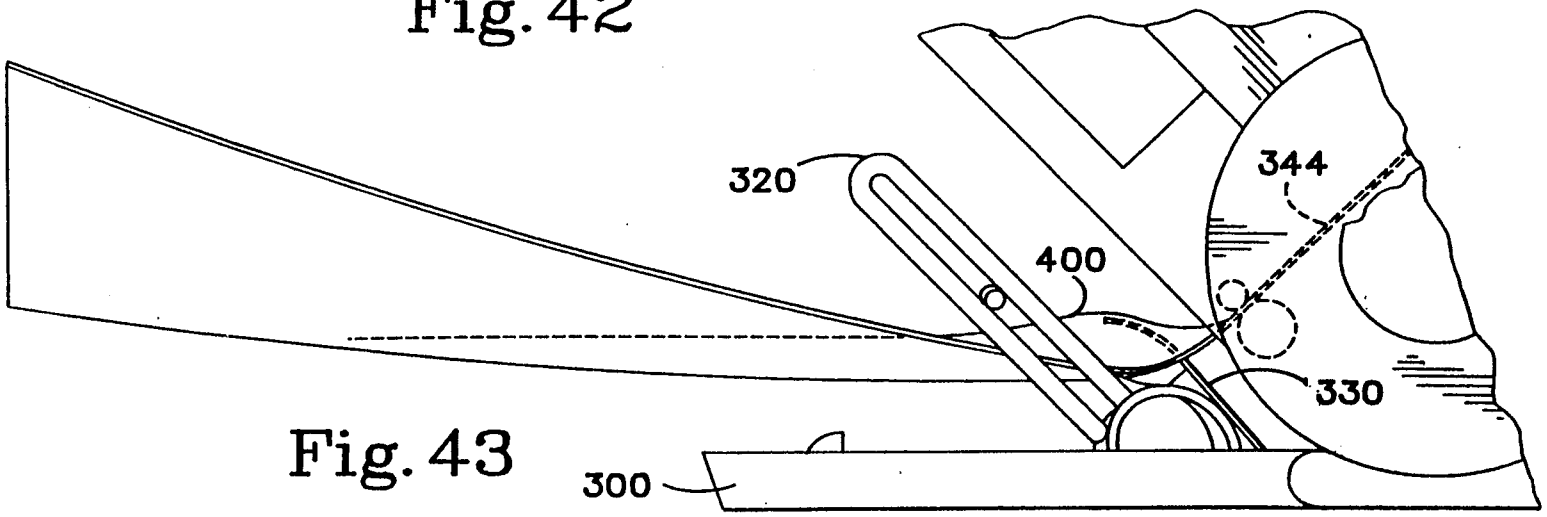

Stage 3 is illustrated in FIG. 43. This shows how the bow-shape imparts rigidity to the media, so that it supports itself over the base, even after a majority of the sheet has exited the printer, as long as the trailing edge is still inside the paper exit slot, where it is positioned by output rollers.

Stage 4—Controlled Drop

Figure 44:
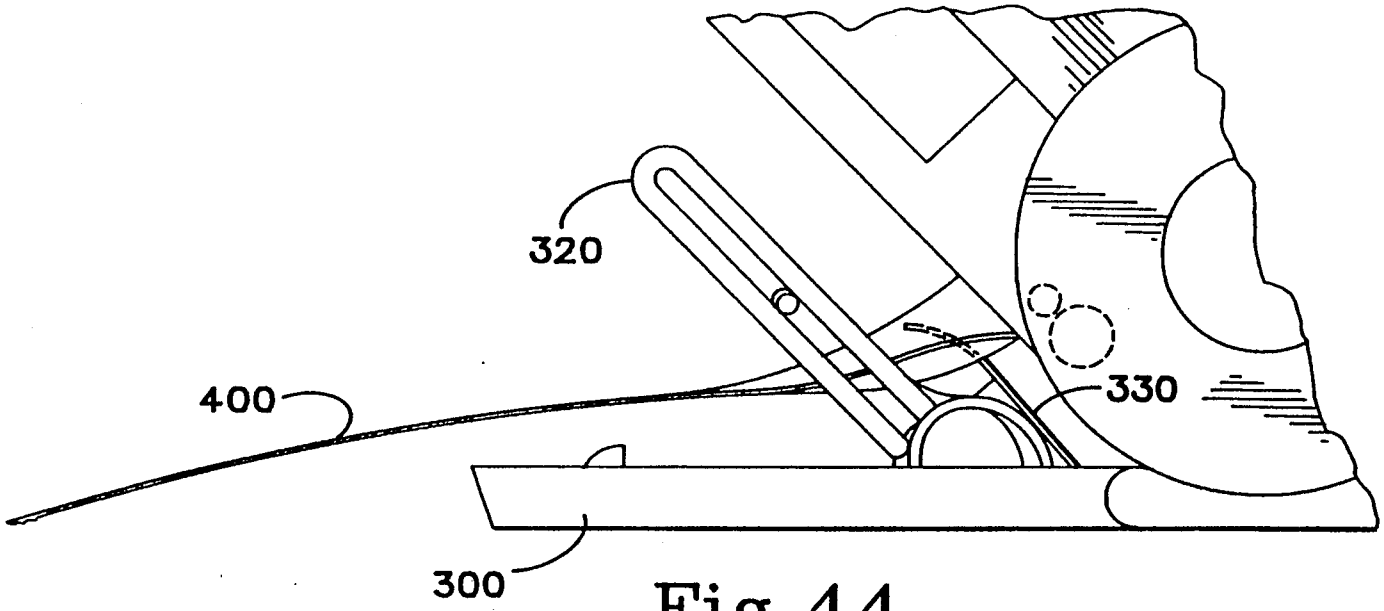

After completion of printer, when the media trailing edge exits the printer, the transversed bow-shape earlier formed is released. As a result, the media loses its rigidity and consequently, the leading edge of the media drops, as illustrated in FIG. 44.

Also at this point in the process, the trailing edge comers of the media pop up into the corresponding trap pockets 350, 360 in the pen access door. This prevents the media from being sucked back into the mechanism as the output rollers reverse to pick up the next page, hereinafter referred to as the following page. The comer portions of the media fit into the trap pockets as shown in the enlarged view of the right trap pocket of FIG. 46.

Stage 5—Trap Pockets and Trailing Edge Formation

Figures 45, 46:
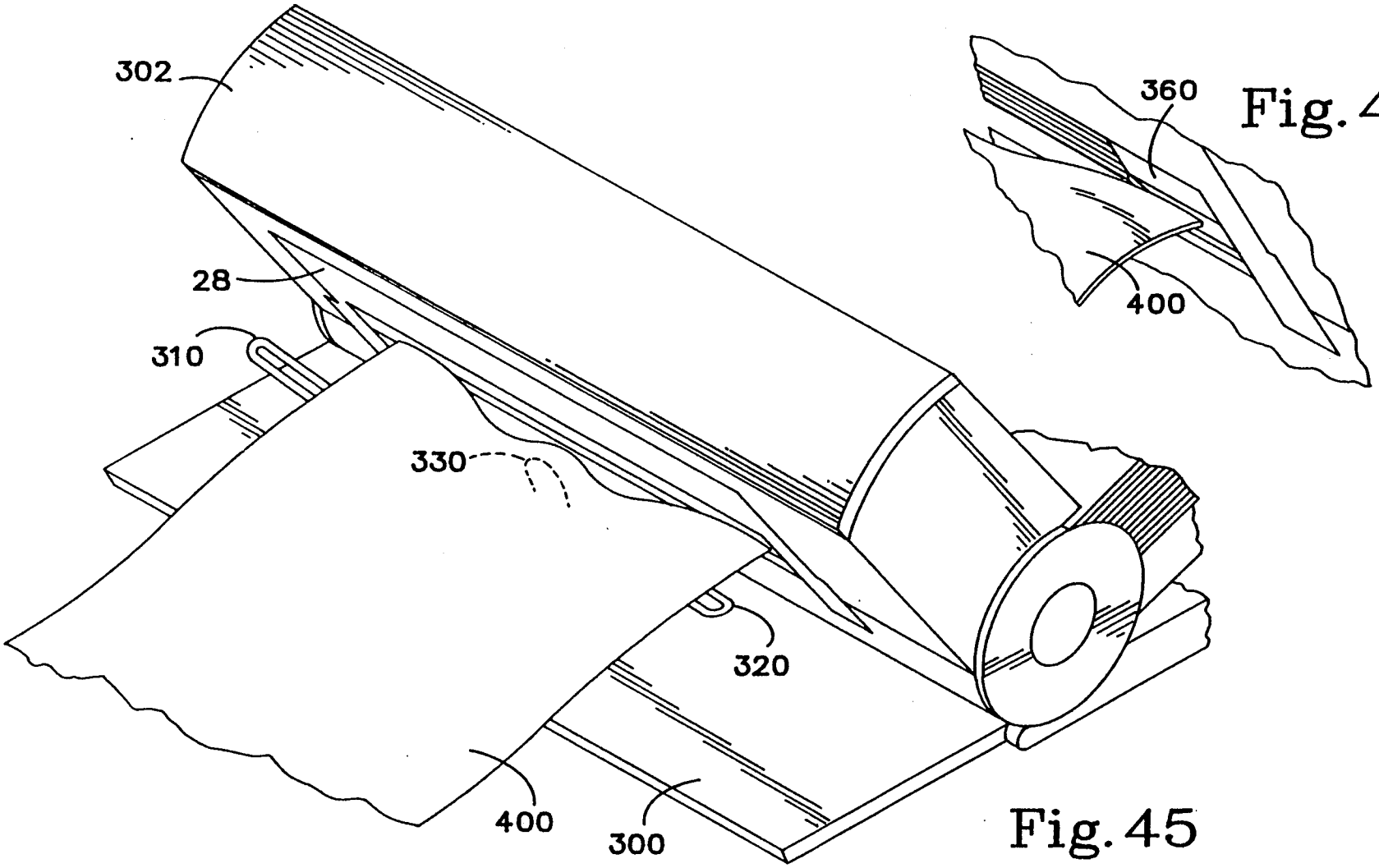
FIG. 46 is an enlarged partial perspective view of the access door trap pocket region of the printing system in operation.

The wet paper path system imparts a W-shaped transverse bow along the trailing edge of the current page, as illustrated in perspective view in FIG. 45.

Referring to FIG. 45, the lateral edges of the media 400, in the vicinity of the trailing edge, are deflected upward by the deflector wings 310, 320. However, the respective comers of the media are confined by the corresponding trap pocket 350, 360, thereby imparting a downward bow toward the center in the trailing edge of the media. However, a central region near the trailing edge of the media is now supported by the edge separator 330, so that the trailing edge acquires a W-shape.

Since the current media 400 has now exited the printer, it is no longer driven by the output rollers. It therefore pauses in its present position until such time as a following media is ejected from the printer. The W-shaped bow in the trailing edge of the current media ensures proper contact with the leading edge of the following sheet, so that the following sheet will drive the current sheet further ahead.

Stage 6

Figure 47:
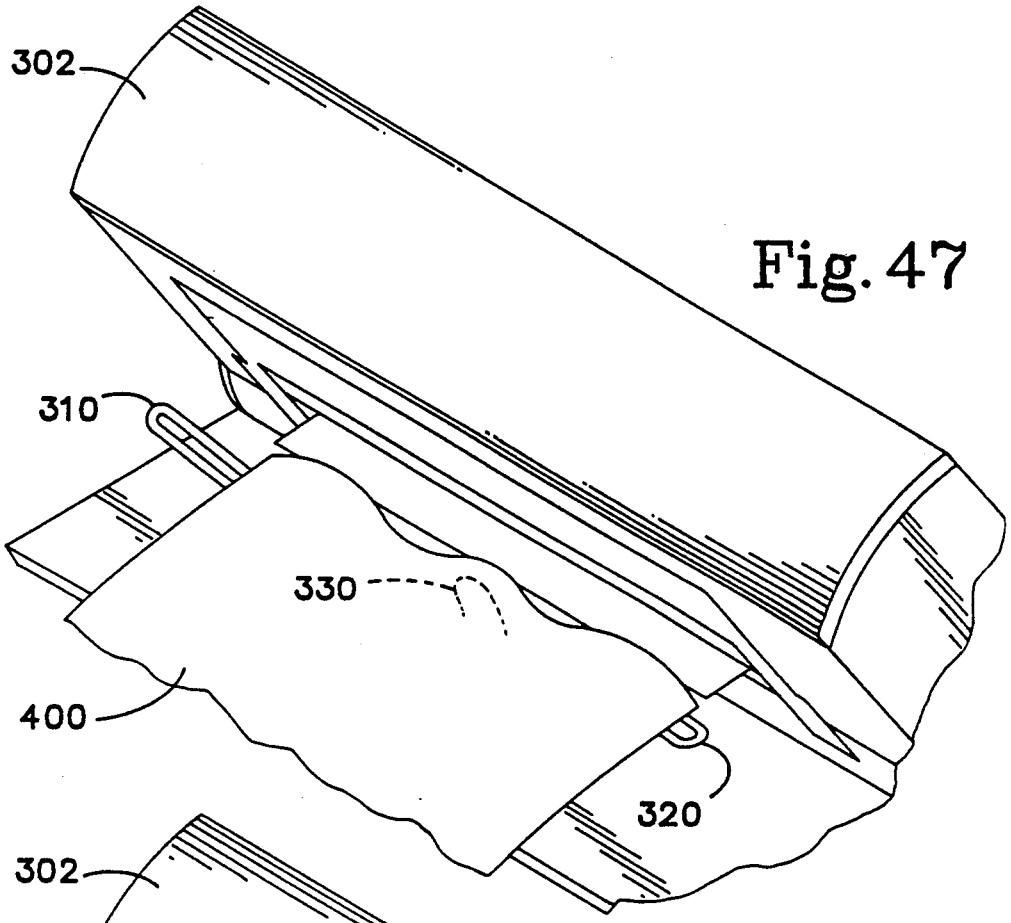
FIG. 47 illustrates how the straight leading edge of a printed page contacts the W-shaped trailing edge of a previously printed page for driving the previously printed page onto the output platform.

As the following media emerges from the printer its leading edge engages the W-bow at the trailing edge of the previous page and drives the previous page along the deflector wings as shown in FIG. 47.

Stage 7—Page Breaking

Figure 48:
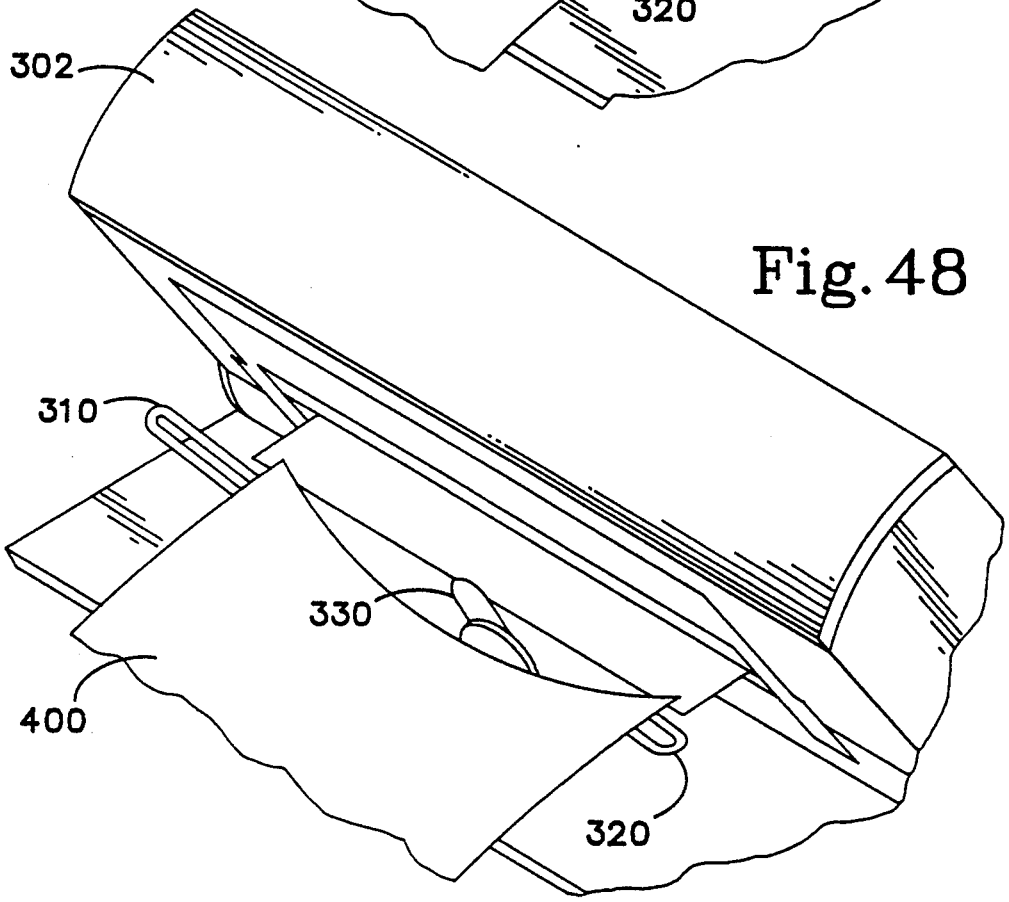
FIG. 48 illustrates a trailing edge of a printed page after it clears the edge separator and contacts with the leading edge of a successive page.

When the trailing edge of the current media clears the edge separator, the center of the trailing edge is no longer supported, although the lateral edges continue to be deflected upward by the deflector wings. As a result, the center of the trailing edge flips down so that the trailing edge acquires a generally U-shaped bow, as shown in FIG. 48. This restores stiffness to the page, as described previously. The U-shape trailing edge assures continued contact with the leading edge of the following sheet.

Stage 8—Stacking

Figure 49:
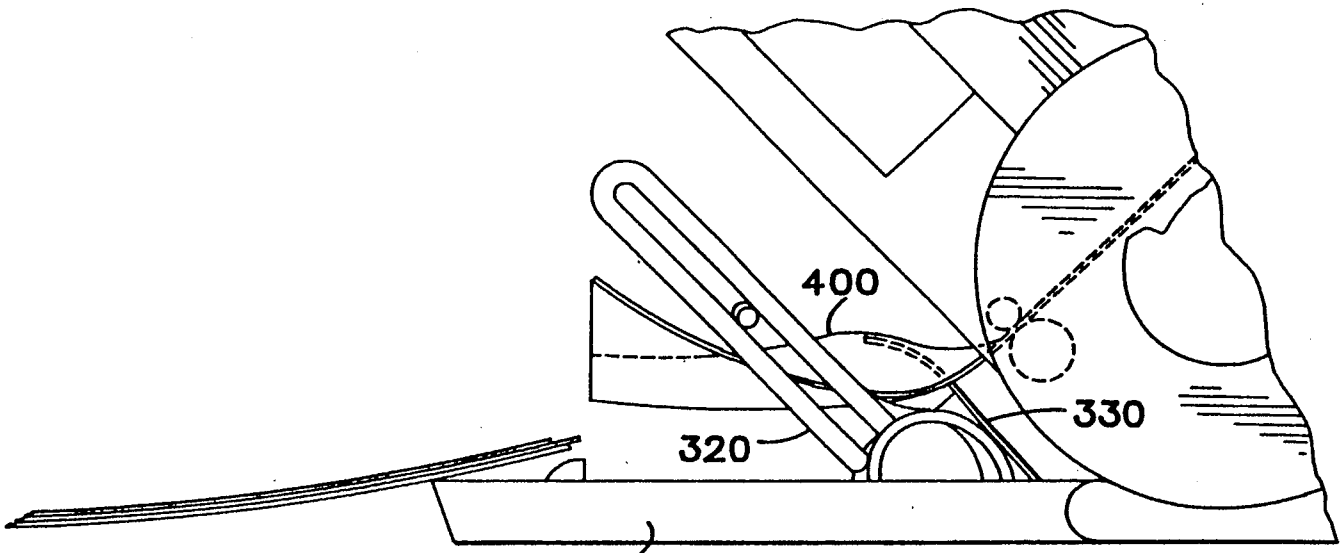
FIG. 49 is a side view illustrating how the leading edge of a printed page pushes the previously printed page over the deflector wings so that the previously printed page falls onto a stack on the output platform.

As the leading edge of the following sheet continues its inclined motion along the deflector wings, it pushes the current sheet off of the wings and allows it to drop onto the output platform. As successive sheets are printed and output in the manner described, they stack neatly onto one another in proper order, as shown in FIG. 49.

The foregoing methods and apparatus have the following advantages. The printed media is maintained spaced above a previously printed sheet while the current sheet is being printed. Only when the trailing edge exits the printer does the leading edge fall onto the previous sheet. Since the leading edge falls on an area of the previous page distal from the exit slot, that region has had a maximum amount of time to dry since it was printed. Once the leading edge falls onto the stack, the printed page remains in that position, with the trailing portion of the page supported above the output stack, until the following page is printed and ejected from the printer. As the following page exits the printer slots, it drives the previous page off of the deflector wings, allowing it to finally fall into place onto the stack. This has the advantage of maximizing the time delay before the printed page impacts the wettest portion of the stack, and provides for neat stacking of output media, all in a completely passive apparatus.

The Deflector Wings

FIG. 31 shows detail of the deflector wings 310, 320. The deflector wing itself is shown in side elevation in FIG. 31C. The right wing 320, for example, includes an elongate portion 312 fixed to a base portion 314. The deflector wing preferably is formed of a plastic material for lightweight and economical construction. The base portion 314 includes a pair of mounting pins 316 for snapin connection to corresponding mounting holes on the output platform 300 or on a slider, in the case of the left deflector wing, described below.

The left deflector wing is illustrated in FIGS. 31A and 31B. The left deflector wing further includes a slider portion 318. The slider 318 is movably connected to a corresponding channel in the output platform 300 so as to permit lateral positioning of the left deflector wing in order to accommodate printed media of various widths. The slider 318 is connected to the output platform by means of a suitable snap-in hook 322.

As described above, the printing system may be configured into a travel mode in which the output platform 300 and the output side of the printer 10 are closed into parallel proximity with each other. For that reason, the deflector wings, as well as the edge separator, are pivotally connected to the output platform and arranged to fold down into a travel position, substantially flush with the output platform. For that reason, the deflector wings include torsion springs arranged to urge the deflector wings upward toward an operational position for use, while allowing them to pivot down into the travel position automatically. A suitable stop is provided so that the deflector wings as well as the edge separator automatically spring upward into a predetermined position for use when the printer is configured in the automatic feed mode.

We claim:

1. A method for configuring a printer having a battery and a case comprising the steps of:

placing the printer in a configuration mode;

providing a menu affixed to said case on the printer which includes a plurality of configurable printer features, and a plurality of different configuration options associated with each feature including a left-most and a right-most configuration option, the menu further including a battery charge indicator having a plurality of charge level indicators thereon, all of said printer features, configuration options and level indicators being displayed on a linear path across said menu;

providing a pointer on a printer carriage mounted on the printer, said pointer being oriented to point at said linear path when the printer carriage moves relative to the menu;

detecting the battery charge level;

generating a signal proportional to the battery charge level; moving the printer carriage responsive to the battery charge level signal until the pointer points to the batter charge indicator level corresponding to the battery charge level;

moving the printer carriage until the pointer points at a selected configuration option associated with one of the printer features; and selecting the configuration option at which the pointer points.

2. The method of claim 1 wherein said method further includes the steps of:

moving the printer carriage until the pointer points at a configuration option associated with the next adjacent printer feature;

moving the printer carriage until the pointer points at a selected configuration option associated with the adjacent printer feature; and selecting the configuration option at which the pointer points.

3. An apparatus for configuring a printer having a battery, a case and a printer carriage movable relative to said case, said apparatus comprising:

a menu mounted on said case, said menu displaying a plurality of configurable printer features and a plurality of different configuration options associated with each feature, including a left-most and a right-most configuration option, the menu further including a battery charge indicator having a plurality of charge level indication thereon, all of said printer features, configuration options, and level indicators being displayed on a linear path across said menu;

a pointer mounted on said printer carriage, said pointer being oriented to point at said linear path when the printer carriage moves relative to the menu;

means for placing the printer in a configuration mode;

means for detecting the battery charge level;

means for generating a signal porportional to the battery charge level;

means for moving the printer carriage responsive to the battery charge level signal until the pointer points to the battery charge indicator level corresponding to the battery charge level;

means for moving the printer carriage until the pointer points at a selected configuration option associated with one of the printer features; and means for selecting the configuration option at which the pointer points.

4. The apparatus of claim 3 wherein said apparatus further includes means for moving the printer carriage until the pointer points at a configuration option associated with a selected one of the printer features on the menu.

5. A method for configuring a printer comprising the steps of:

placing the printer in a configuration mode;

providing a menu affixed to a case on the printer which includes a plurality of configurable printer features and a plurality of different configuration options associated with each feature, all of said printer features and configuration options being displayed on a linear path across said means;

providing a pointer on a printer carriage mounted on the printer, said pointer being oriented to point at each configuration option on the menu when the printer carriage moves relative to the menu;

moving the printer carriage until the pointer points at a selected configuration option associated with one of the printer features;

selecting the configuration option at which the pointer points;

automatically moving the printer carriage to the currently selected configuration option associated with the next adjacent printer feature responsive to a user-actuated signal provided to said printer; and maintaining the printer carriage at the currently selected configuration option to indicate to the user the currently selected configuration option associated with the next adjacent printer feature.

6. The method of claim 5 wherein said method further includes the step of moving the printer carriage between the configuration options associated with the feature at which the pointer points until the pointer points to a desired configuration option, the carriage moving from left to right responsive to a second user-actuated signal wherein the carriage moves from the right-most option to the left-most option responsive to the second user-actuated signal when the pointer points to the right-most option and the carriage moving right to left responsive to a third user-actuated signal input wherein the carriage moves from the left-most option to the right-most option responsive to the third user-actuated signal when the pointer points to the left-most option.

7. An apparatus for configuring a printer which has an exterior case and a printer carriage movable relative to said case, said apparatus comprising:

a menu mounted on said case, said menu displaying a plurality of configurable printer features and a plurality of different configuration options associated with each feature, all of said printer features and configuration options being displayed on a linear path across said menu;

a pointer mounted on said printer carriage, said pointer being oriented to point at each configuration option on the menu when the printer carriage moves relative to the menu;

means for placing the printer is a configuration mode;

means for moving the printer carriage until the pointer points at a selected configuration option associated with one of the printer features;

means for selecting the configuration option at which the pointer points;

means for automatically moving the printer carriage to the currently selected configuration option associated with the next adjacent printer feature; and means for maintaining the printer carriage of the currently selected configuration option to indicate to the user the current selected configuration option associated with the next adjacent printer feature.

8. The apparatus of claim 7 wherein said apparatus further including means for moving the printer carriage between the configuration options associated with the feature at which the pointer points until the pointer points to a desired configuration option, the carriage moving from left to right responsive to a second user-actuated signal wherein the carriage moves from the right-most option to the left-most option responsive to the second user-actuated signal when the pointer points to the right-most option and the carriage moving right to left responsive to a third user-actuated signal input wherein the carriage moves from the left-most option to the right-most option responsive to the third user-actuated signal when the pointer points to the left-most option.

* * * * *